US008926455B2

(12) United States Patent
Drozjock et al.

(10) Patent No.: US 8,926,455 B2
(45) Date of Patent: Jan. 6, 2015

(54) APPARATUSES FOR IMPROVING THROWING TECHNIQUE AND METHODS OF USING SAME

(75) Inventors: John J. Drozjock, Califon, NJ (US); Dawn M. Kreizer-Drozjock, Califon, NJ (US)

(73) Assignee: Gear LLC, Califon, NJ (US)

( * ) Notice: Subject to any disclaimer, the term of this patent is extended or adjusted under 35 U.S.C. 154(b) by 77 days.

(21) Appl. No.: 13/403,377

(22) Filed: Feb. 23, 2012

(65) Prior Publication Data

US 2012/0231903 A1 Sep. 13, 2012

Related U.S. Application Data

(60) Provisional application No. 61/449,904, filed on Mar. 7, 2011.

(51) Int. Cl.
*A63B 69/00* (2006.01)
*A63B 63/08* (2006.01)

(52) U.S. Cl.
CPC ..... *A63B 69/0059* (2013.01); *A63B 69/0071* (2013.01); *A63B 69/00* (2013.01); *A63B 63/083* (2013.01); *A63B 2243/0025* (2013.01); *A63B 2243/0066* (2013.01); *A63B 69/0002* (2013.01); *A63B 2069/0006* (2013.01); *A63B 2209/10* (2013.01); *A63B 2243/007* (2013.01)
USPC ..... 473/422; 473/450; 473/458; 473/438

(58) Field of Classification Search
CPC ..... A63B 69/0071; A63B 69/0059; A63B 69/0002; A63B 69/00; A63B 63/083; A63B 2069/0006; A63B 2243/0025; A63B 2243/007; A63B 2243/0066
USPC ..... 473/422, 450, 458, 460, 453, 212, 214, 473/215, 438; D21/685; 482/51, 88; 2/463, 2/468, 92
See application file for complete search history.

(56) References Cited

U.S. PATENT DOCUMENTS 3,413,000 A * 11/1968 Alkonis ..... 473/61
3,496,573 A * 2/1970 Pope et al. ..... 473/450

(Continued)

FOREIGN PATENT DOCUMENTS

WO WO 2008/115900 A1 9/2008

OTHER PUBLICATIONS

International Searching Authority, International Search Report and Written Opinion for International Application No. PCT/US2012/026283, mailed Jun. 21, 2012, 11 pages, European Patent Office, The Netherlands.

*Primary Examiner* — Mitra Aryanpour
(74) *Attorney, Agent, or Firm* — Alston & Bird LLP

(57) ABSTRACT

Various embodiments provide apparatuses configured for improving a ball throwing technique of a user thereof. The apparatuses generally comprise one or more body portions configured to at least partially surround at least a first portion of an arm of the user, and one or more flexible portions configured to at least partially surround and secure at least a second portion of the arm of the user, the second portion being oppositely positioned relative to the first portion. The apparatuses may further comprise at least one connector element configured to selectively attach the one or more flexible portions to the one or more body portions. Various embodiments still further incorporate a wedge portion that creates a gap between a user's palm and the ball being thrown. Still other embodiments comprise extension and rotation mechanisms for apparatus adjustments. Methods of using the various apparatuses are also provided.

41 Claims, 29 Drawing Sheets

(56) References Cited

U.S. PATENT DOCUMENTS

| | | | | | |
|---|---|---|---|---|---|
| 3,501,773 | A * | 3/1970 | Stansberry et al. | 473/438 |
| 4,496,151 | A * | 1/1985 | Tureaud | 473/59 |
| 4,617,684 | A * | 10/1986 | Green et al. | 2/20 |
| 4,875,677 | A * | 10/1989 | Tetreault | 473/458 |
| 5,219,323 | A * | 6/1993 | Singer et al. | 602/16 |
| 5,222,733 | A * | 6/1993 | Brunty | 473/438 |
| 5,279,545 | A * | 1/1994 | Reese, Sr. | 602/21 |
| 5,407,420 | A * | 4/1995 | Bastyr et al. | 602/5 |
| 5,651,743 | A * | 7/1997 | Stephan et al. | 473/450 |
| 5,769,743 | A * | 6/1998 | Stephan et al. | 473/450 |
| 5,833,233 | A * | 11/1998 | Strug | 473/450 |
| 5,865,695 | A * | 2/1999 | Mahala et al. | 473/450 |
| 6,139,476 | A * | 10/2000 | Gallant | 482/114 |
| 6,179,799 | B1 * | 1/2001 | Doran | 602/20 |
| 6,599,263 | B1 * | 7/2003 | Bonutti et al. | 602/20 |
| 7,074,202 | B1 | 7/2006 | Weber et al. | |
| 7,955,285 | B2 * | 6/2011 | Bonutti et al. | 602/16 |
| 8,109,273 | B2 * | 2/2012 | Golden et al. | 128/878 |
| 8,162,782 | B2 * | 4/2012 | Chen | 473/450 |
| 8,292,760 | B2 * | 10/2012 | Johnson | 473/450 |
| 8,414,430 | B2 * | 4/2013 | McKinley | 473/450 |
| 2007/0219025 | A1 * | 9/2007 | Aberton et al. | 473/450 |
| 2013/0172130 | A1 * | 7/2013 | Johnson | 473/453 |

* cited by examiner

APPARATUSES FOR IMPROVING THROWING TECHNIQUE AND METHODS OF USING SAME

CROSS-REFERENCE TO RELATED APPLICATION

This application claims priority to U.S. Provisional Patent Application No. 61/449,904, filed Mar. 7, 2011, which is incorporated herein by reference, together with any and all attachments and exhibits thereto. The full benefit and priority of this application is claimed.

BACKGROUND

1. Field of Invention

The present invention relates generally to apparatuses for improving throwing technique, in particular those comprising at least one body portion and at least one flexible portion configured so as to securely retain at least a portion of a user's arm in a desirable orientation.

2. Description of Related Art

Athletes often employ various training apparatuses and methods to improve the techniques with which they optimize their performance. Oftentimes, these techniques can be as important, if not more important, than any combination of strength, stamina, or talent possessed by a particular athlete. In other words, even assuming all other factors equal, an athlete of inferior strength and stamina may, by using a superior technique, outperform an athlete of superior conditioning and stamina who uses an inferior technique. Thus, superior athletic technique can be a determining factor in not only the future of the individual athletes but also the outcome of any given athletic event.

One area in which athletic technique may be important is that of throwing a ball or other projectile (e.g., javelins, hammers, shot puts, discuses, and the like). Especially so, in the context of throwing a ball such as, for example, a football or a baseball, not only must athletes use the correct shoulder and arm motion, they must also hold the ball with only their fingers and release the ball with an appropriate degree of elbow flexion and wrist pronation. Adverse effects of improper technique include, but are not limited to poor accuracy, lack of distance, poor rotation or spin on the ball, and a generally heightened risk of injury due to stress placed on the athlete's arm and shoulder muscles. Accordingly, a need exists for training apparatuses and methods that compensate for all of these considerations so as to enable an athlete to improve and ideally optimize his or her throwing technique.

BRIEF SUMMARY

Various embodiments of the present invention address the above needs and achieve still other advantages by providing apparatuses comprising at least one body portion and at least one flexible portion configured so as to securely retain at least a portion of a user's arm in a desirable orientation so as to facilitate improvement of throwing technique.

In accordance with the purposes of various embodiments as described herein, an apparatus for improving throwing technique is provided. The apparatus comprises one or more body portions configured to at least partially surround at least a first portion of an arm of the user; one or more flexible portions configured to at least partially surround and secure at least a second portion of the arm of the user, the second portion being oppositely positioned relative to the first portion; and at least one connector element configured to selectively attach the one or more flexible portions to the one or more body portions. In certain embodiments, the apparatus may further comprise a first body portion configured to at least partially surround an upper arm portion of the arm of the user, and a second body portion configured to at least partially surround a lower arm portion of the arm of the user.

In accordance with the purposes of various embodiments as described herein, another apparatus for improving throwing technique is provided. The apparatus comprises a first portion configured to at least partially surround at least an upper arm portion of an arm of the user; a second portion comprising a wedge and configured to at least partially surround at least a lower arm and hand portions of the arm of the user; a first flexible portion, the first flexible portion being configured to at least partially surround and secure the upper arm of the user, such that the first flexible portion and the first body portion together substantially encase and immobilize the upper arm of the user; and a second flexible portion, the second flexible portion being configured to at least partially surround and secure the lower arm and hand of the user, such that the second flexible portion and the second body portion together substantially encase and immobilize the lower arm and hand of the user. In these and still other provided embodiments, the wedge of the second body portion may be further configured to create a gap between a palm of the user's hand and the second body portion, the gap further preventing contact between the palm of the user's hand and a ball during use of the apparatus.

In accordance with the purposes of various embodiments as described herein, a method of using an apparatus for improving throwing technique is provided. The method comprises the steps of: A) providing an apparatus comprising: (i) one or more body portions configured to at least partially surround at least a first portion of an arm of the user; (ii) one or more flexible portions configured to at least partially surround and secure at least a second portion of the arm of the user, the second portion being oppositely positioned relative to the first portion; and (iii) at least one connector element configured to selectively attach the one or more flexible portions to the one or more body portions; B) inserting at least a first portion of a user's arm within the one or more body portions such that the one or more body portions at least partially surround at least the first portion of the user's arm; C) connecting, via the at least one connector element, the one or more flexible portions to the one or more body portions, such that the one or more flexible portions at least partially surround and secure at least the second portion of the user's arm relative to the one or more body portions; and D) throwing a ball with the user's arm constrained within the apparatus. These and still other embodiments may further comprise the step of adjusting the relative positioning of the one or more body portions via (1) an extension mechanism, the extension mechanism being configured to slidably position the one or more body portions relative to each other so as to accommodate differing lengths of the arms of respective users; and/or (2) a rotation mechanism, the rotation mechanism being configured to selectively rotatably position the one or more body portions relative to each other so as to provide an improved throwing technique.

BRIEF DESCRIPTION OF THE SEVERAL VIEWS OF THE DRAWING(S)

The accompanying drawings incorporated herein and forming a part of the specification, illustrate several aspects of the present invention and together with the description serve to explain certain principles of the invention. In the drawings.

Figure 1:
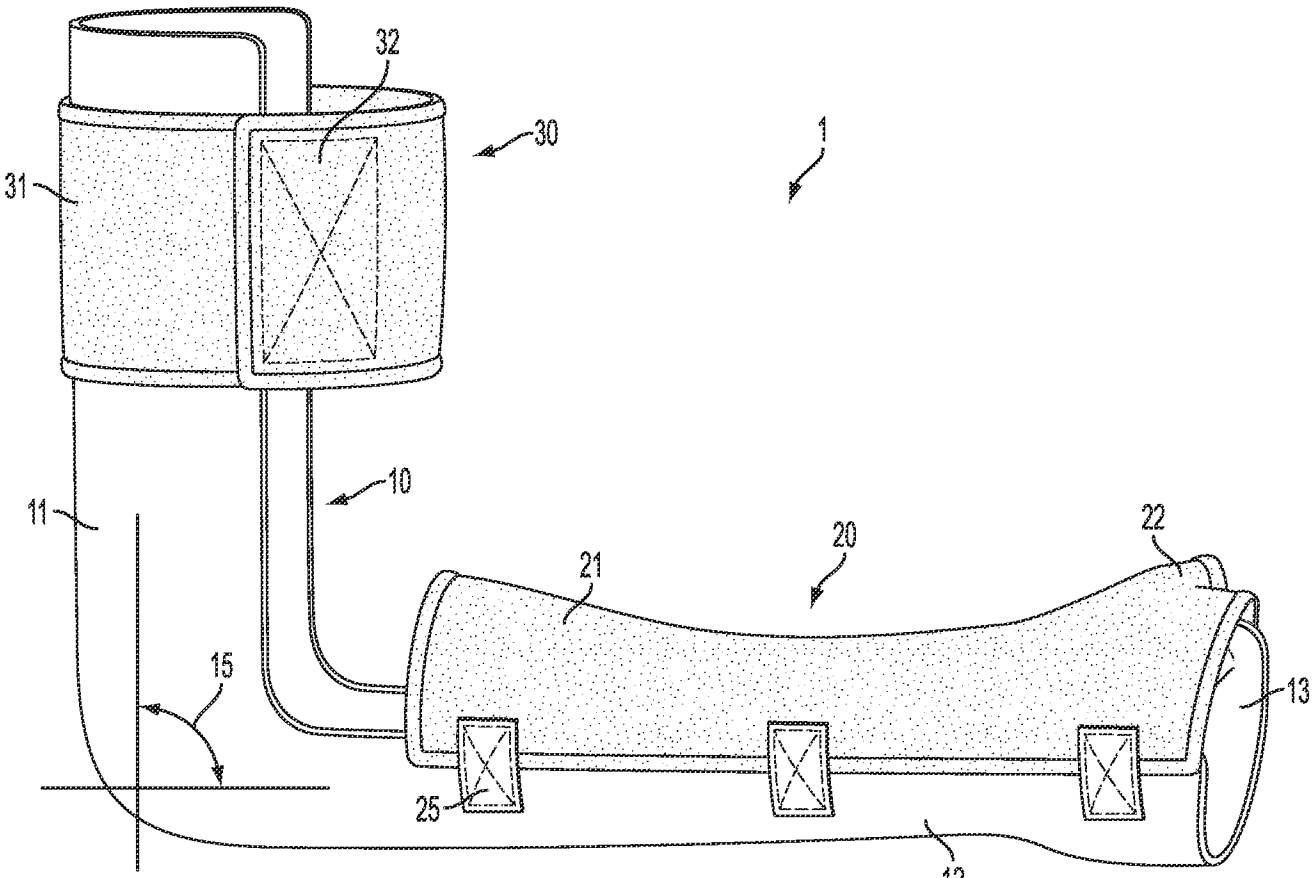
FIG. 1 is a front view of a training apparatus 1 according to a first exemplary embodiment of the invention.
Figure 2:
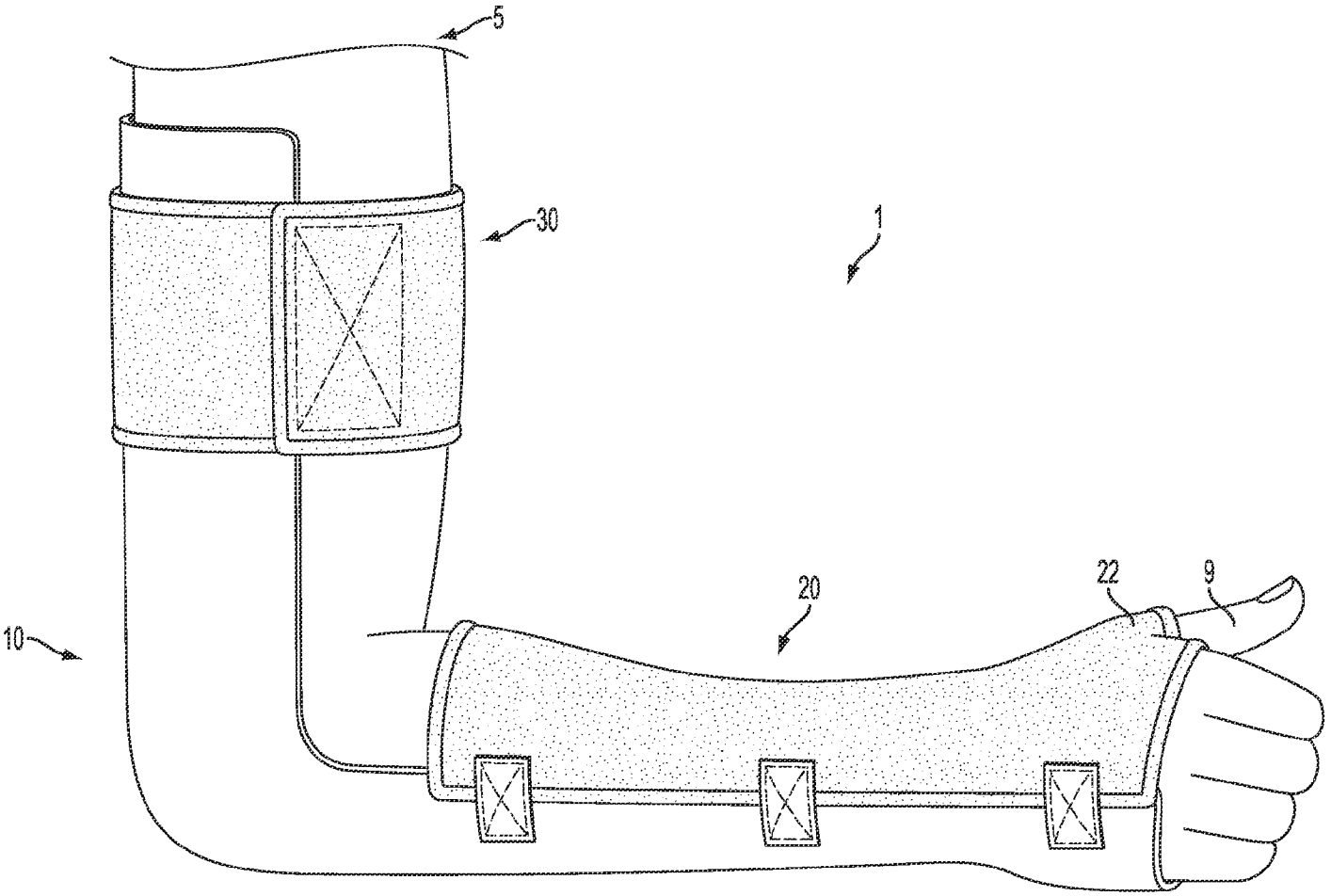
FIG. 2 is a front view of the training apparatus of FIG. 1, further illustrating a user's arm 5 contained within the apparatus 1.
Figure 3:
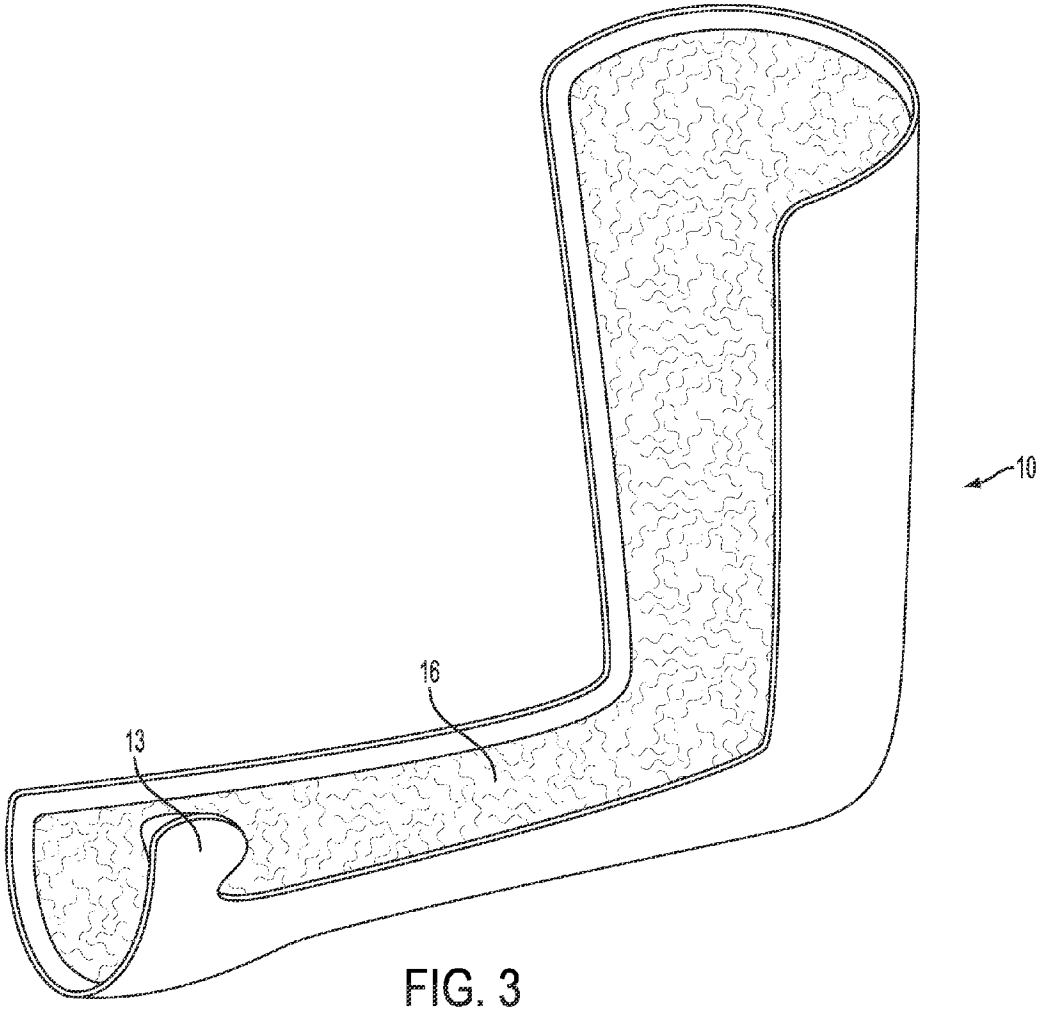
Figure 4B:
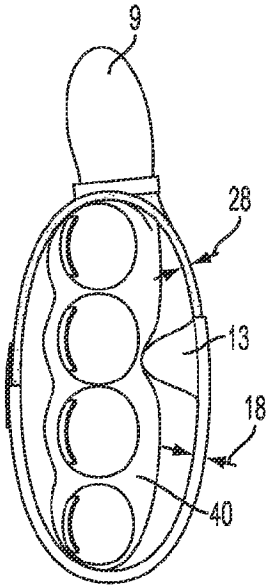
Figure 4A:
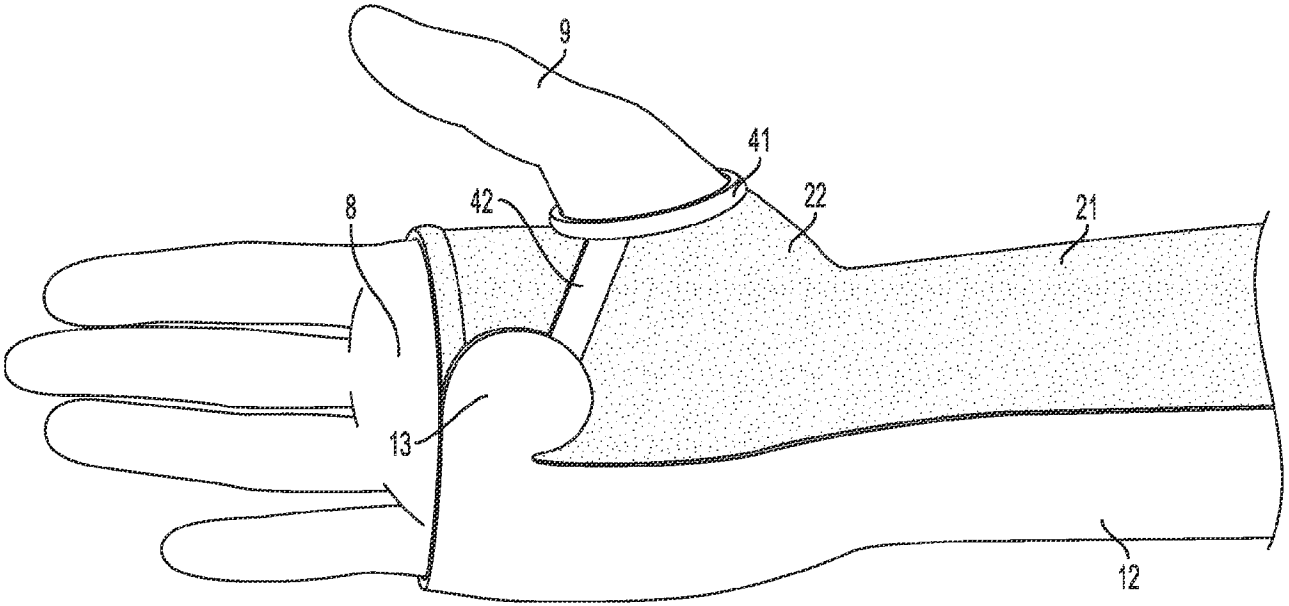
Figure 5A:
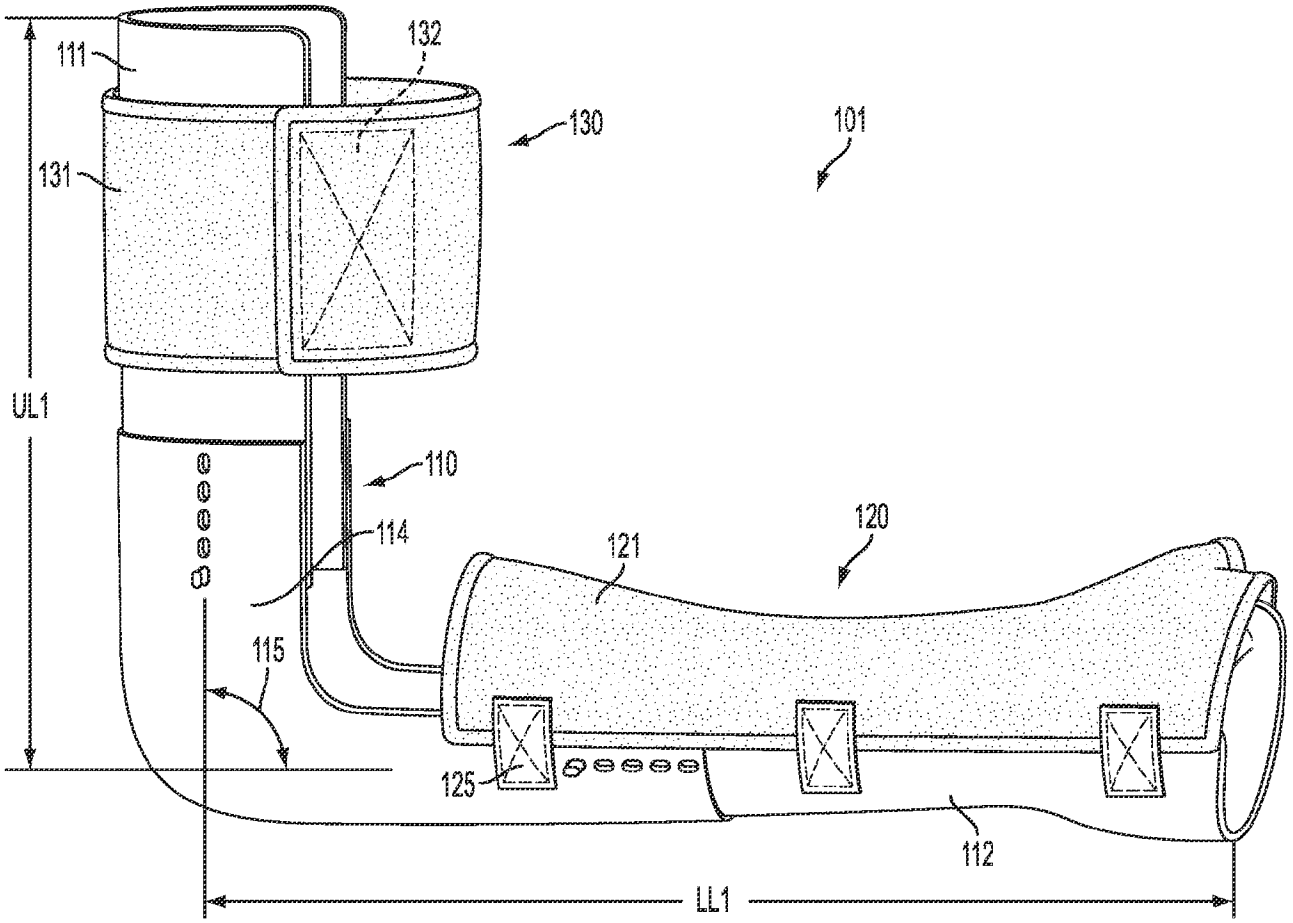
Figure 5B:
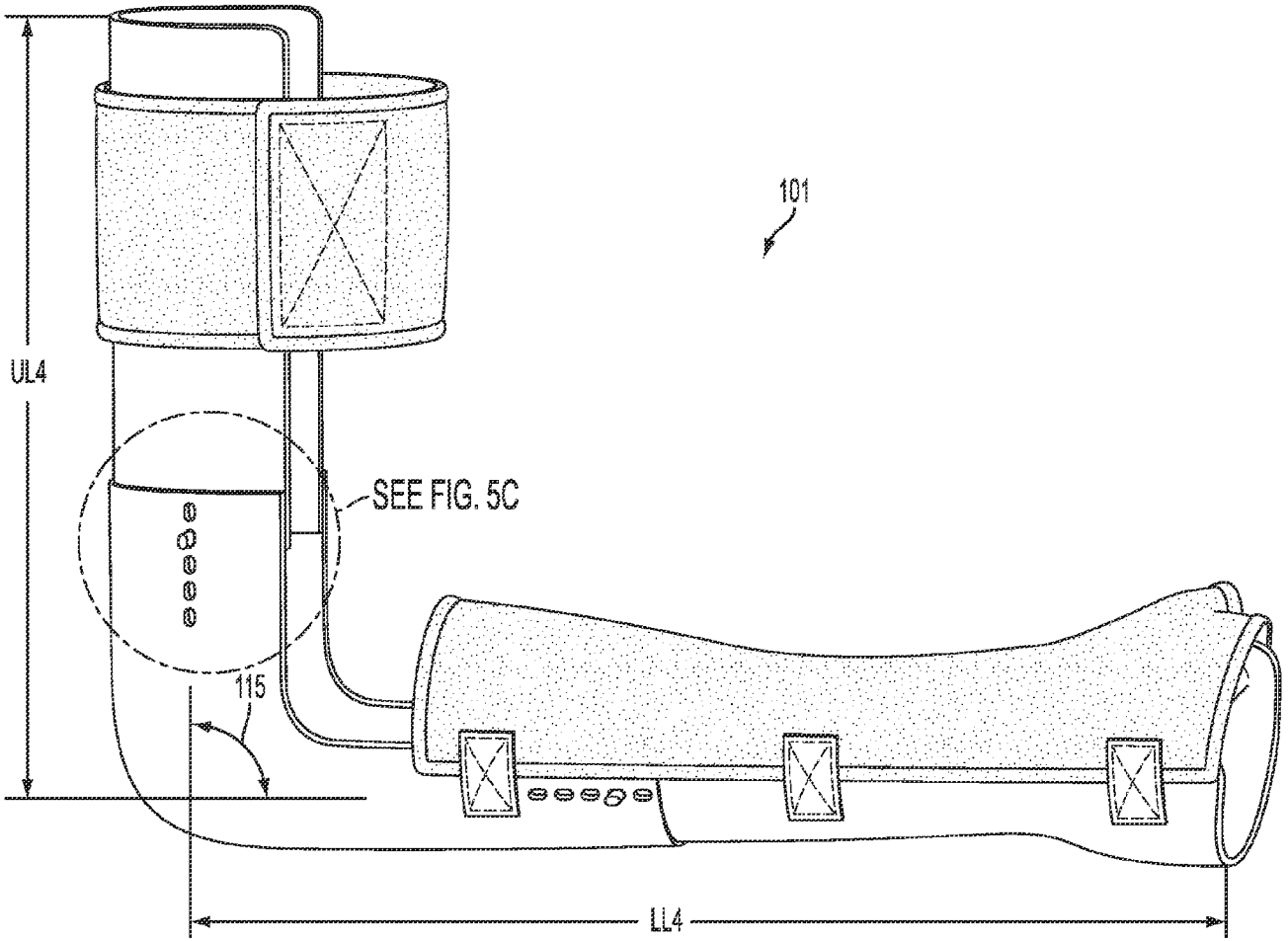
Figure 5C:
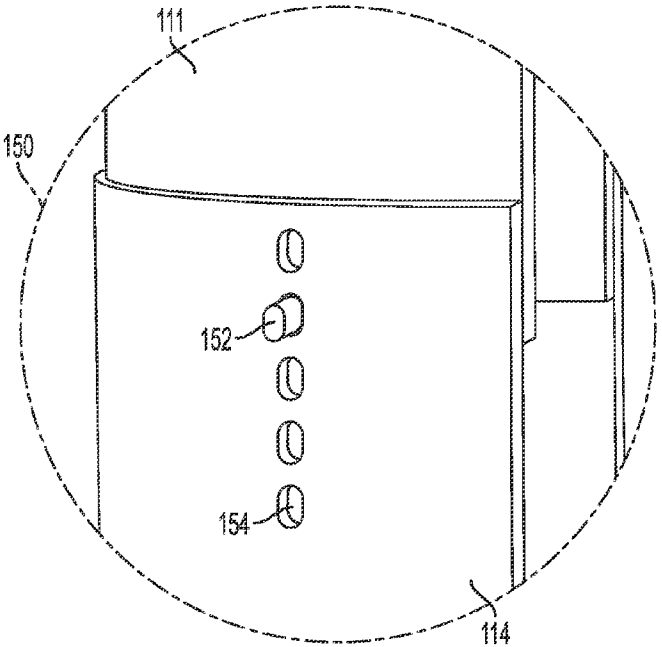
Figure 6:
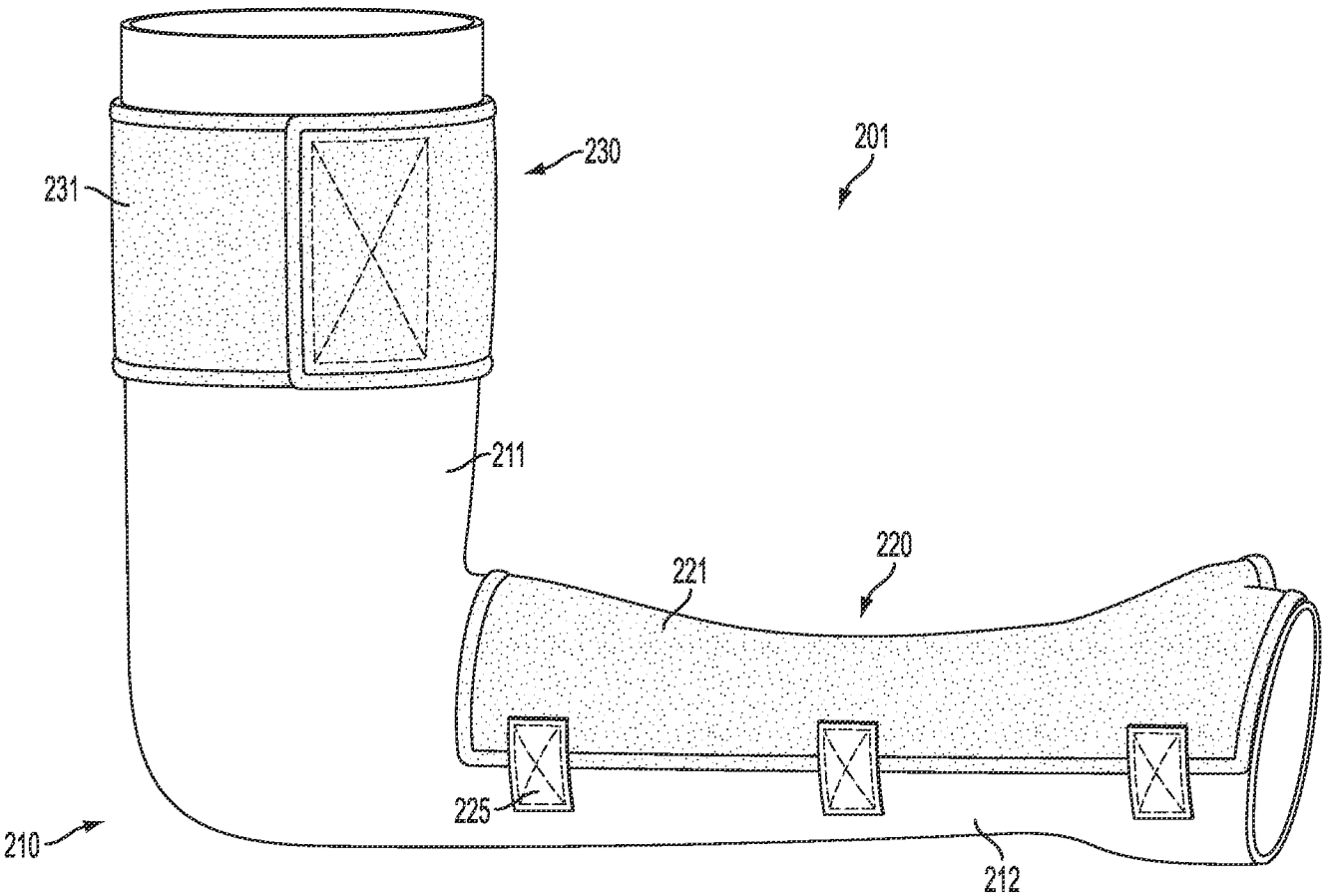
Figure 7:
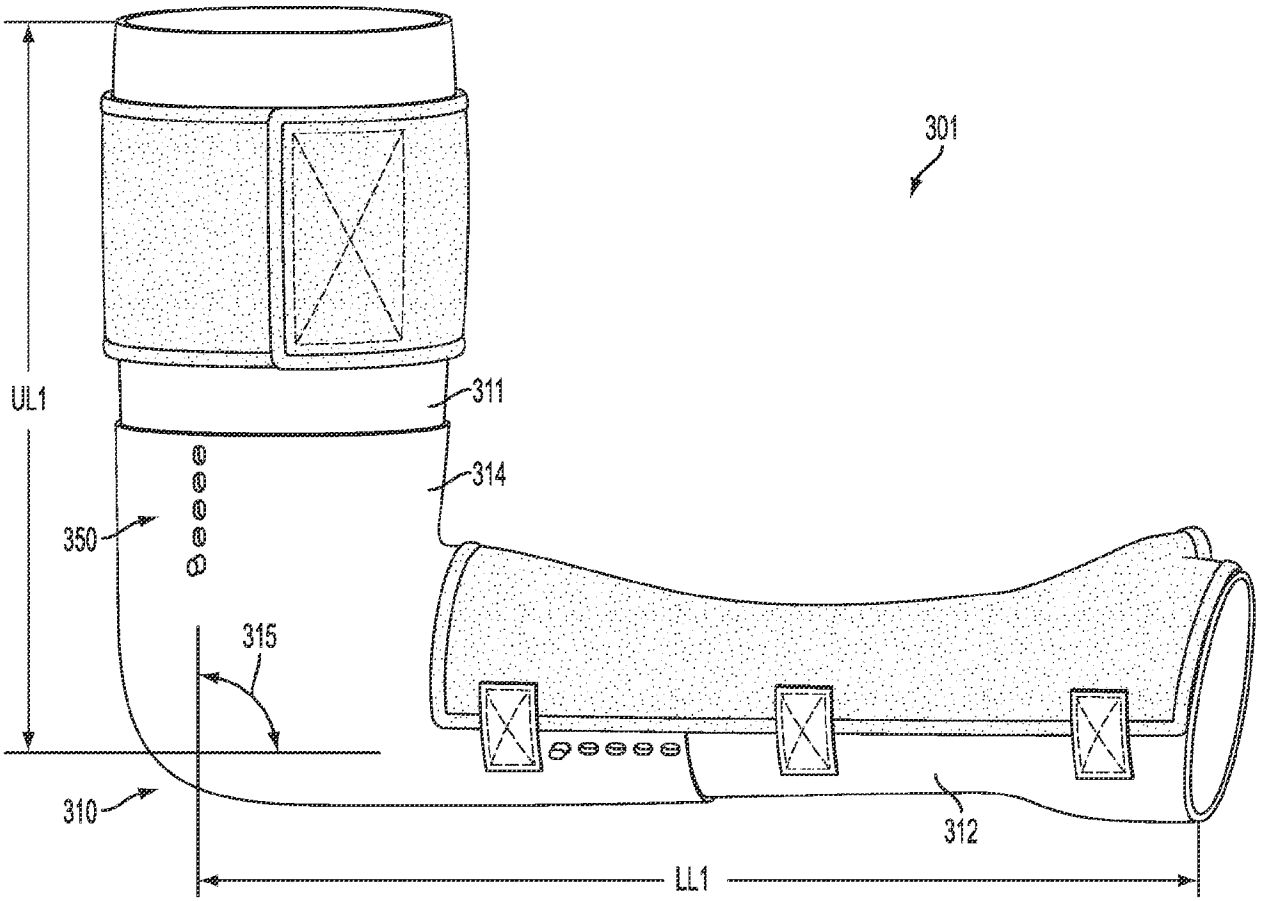
Figure 8:
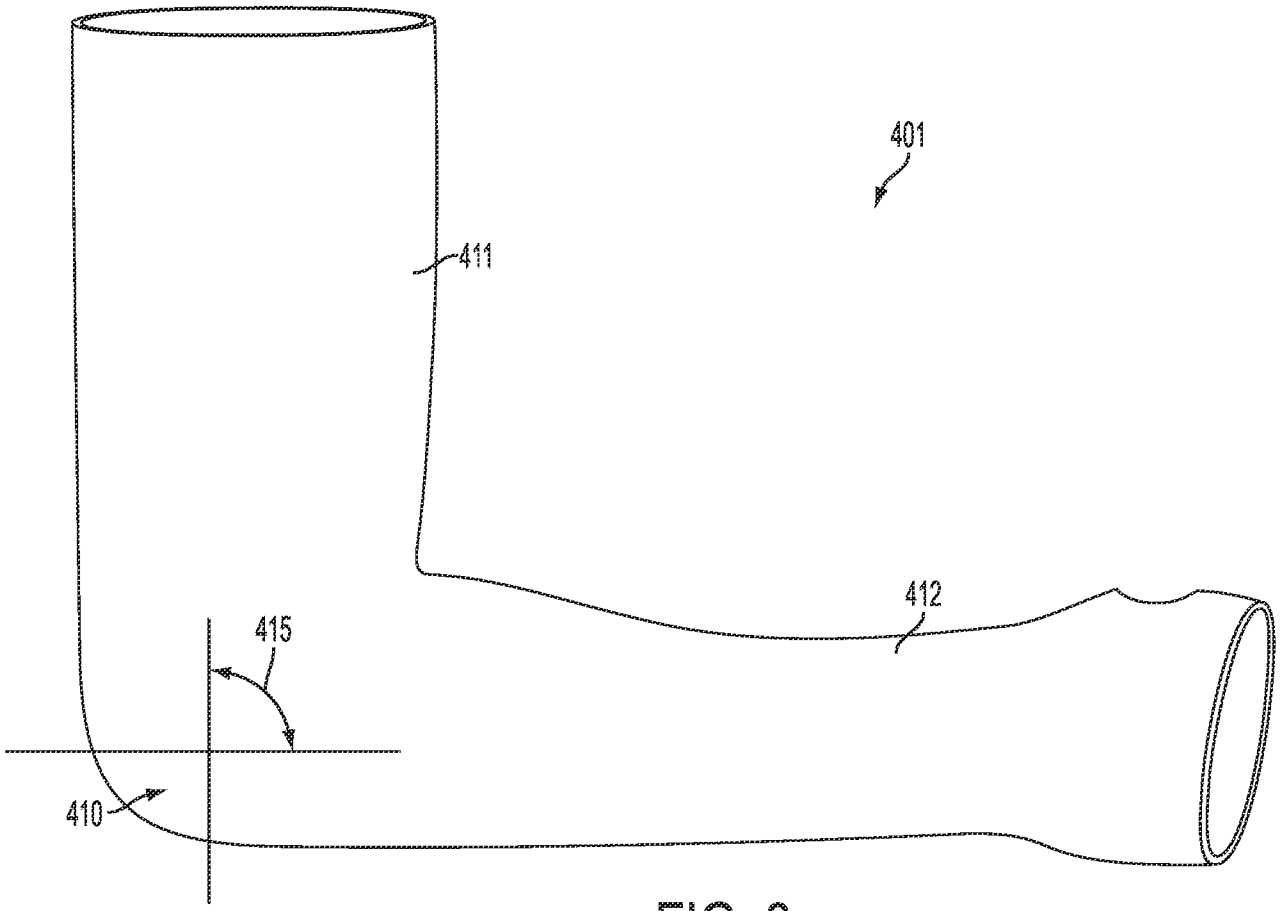
Figure 9:
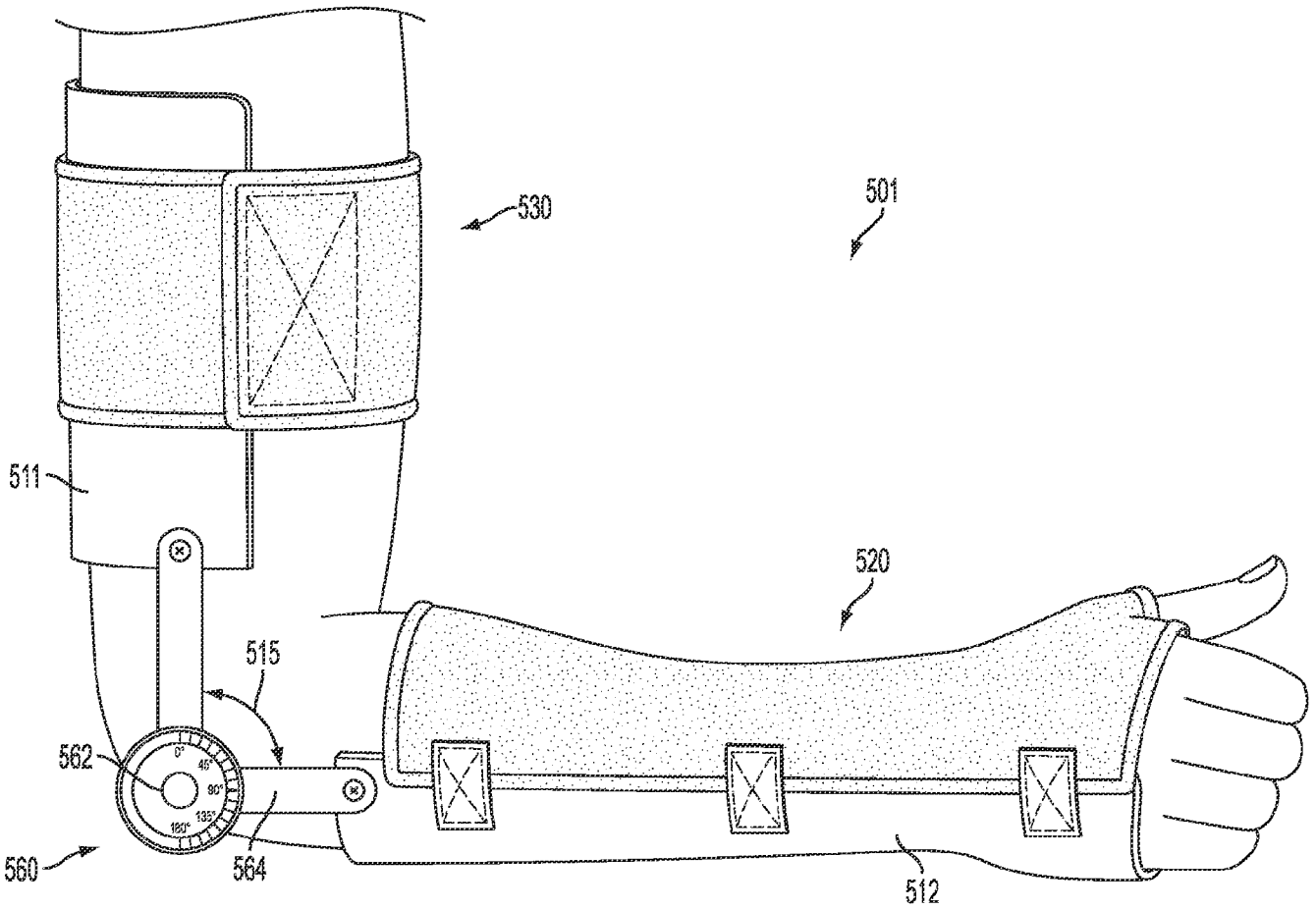
Figure 10:
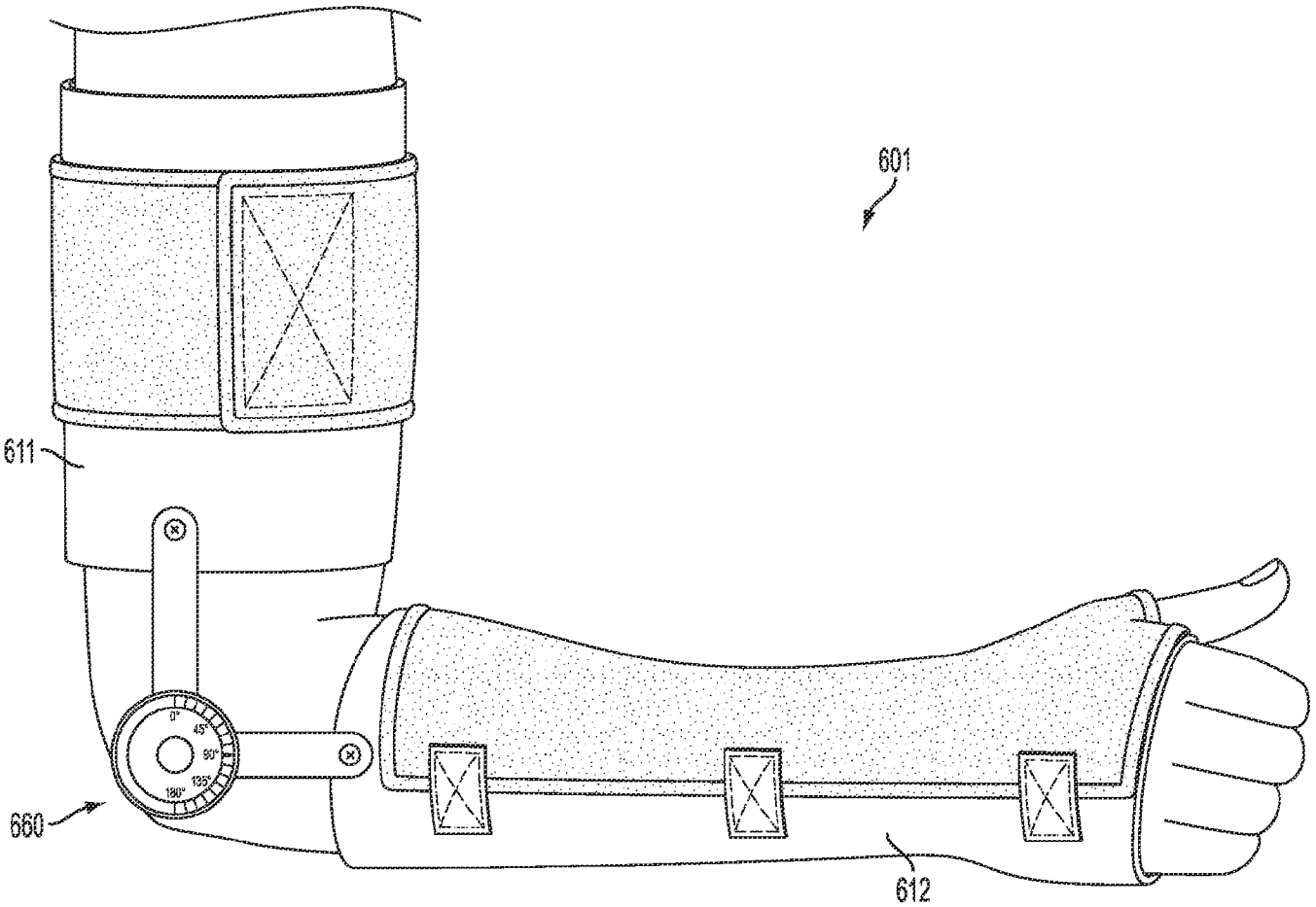
Figure 11:
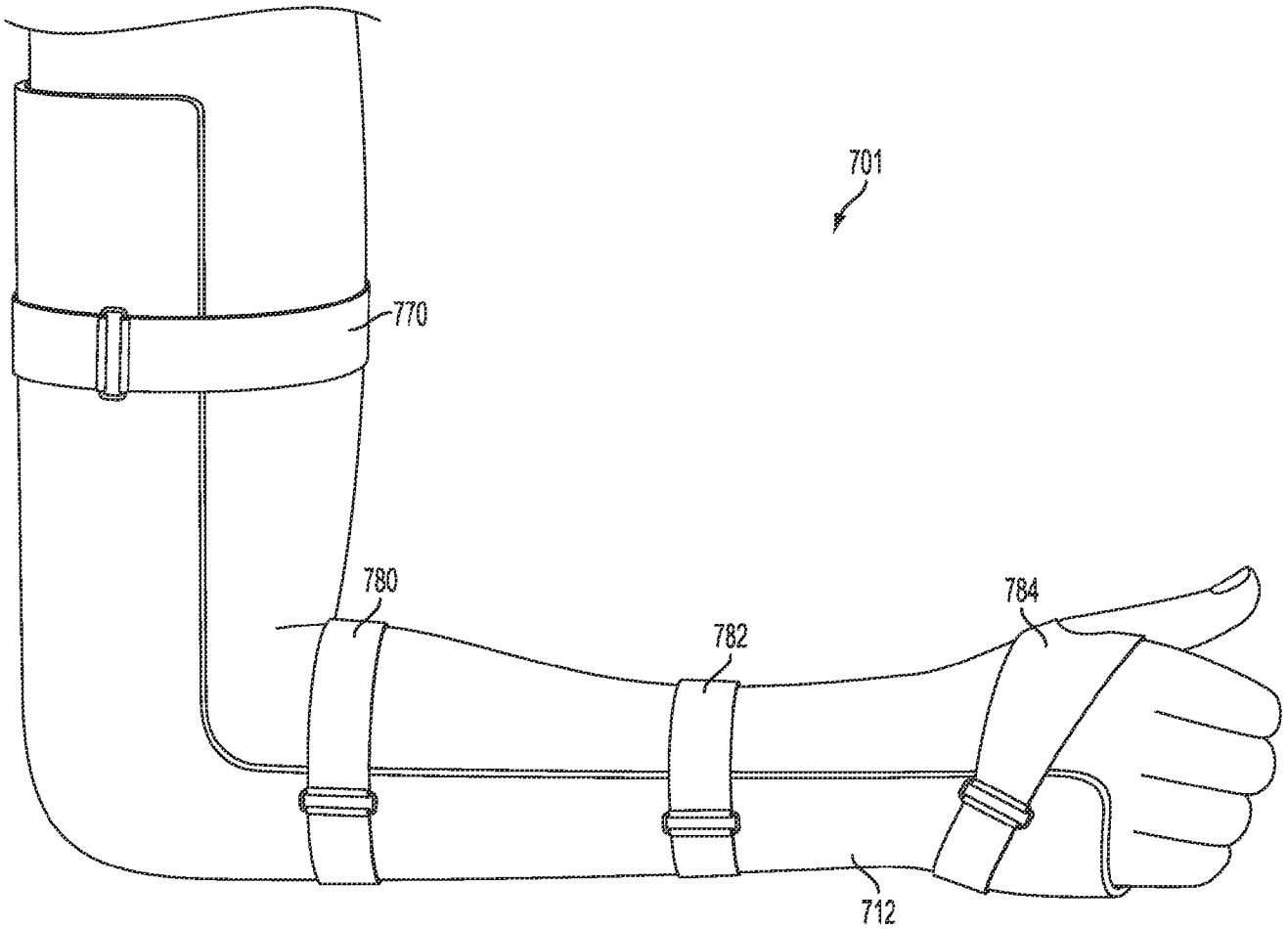
Figure 12A:
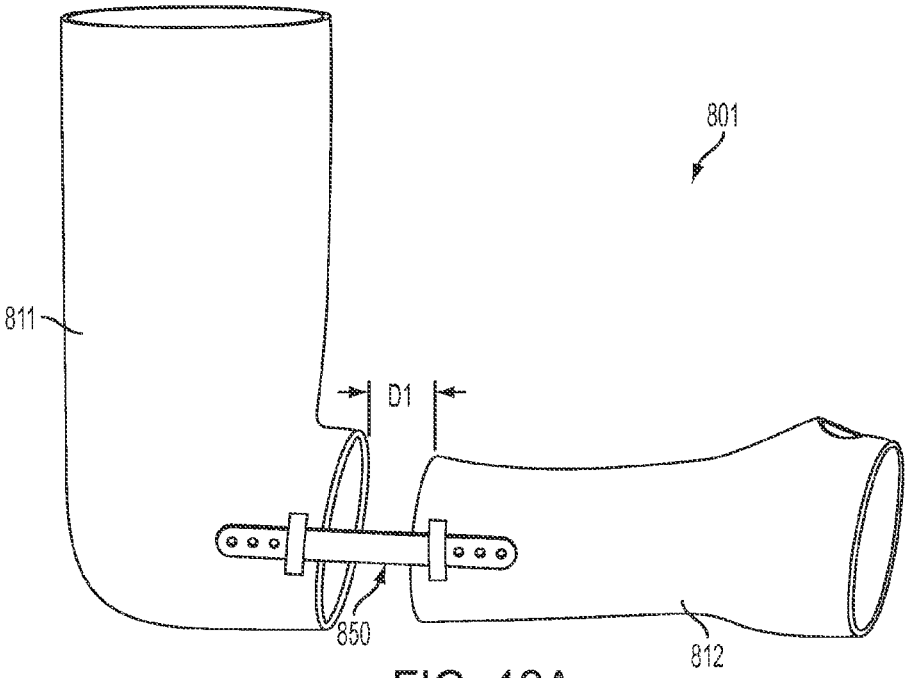
Figure 12B:
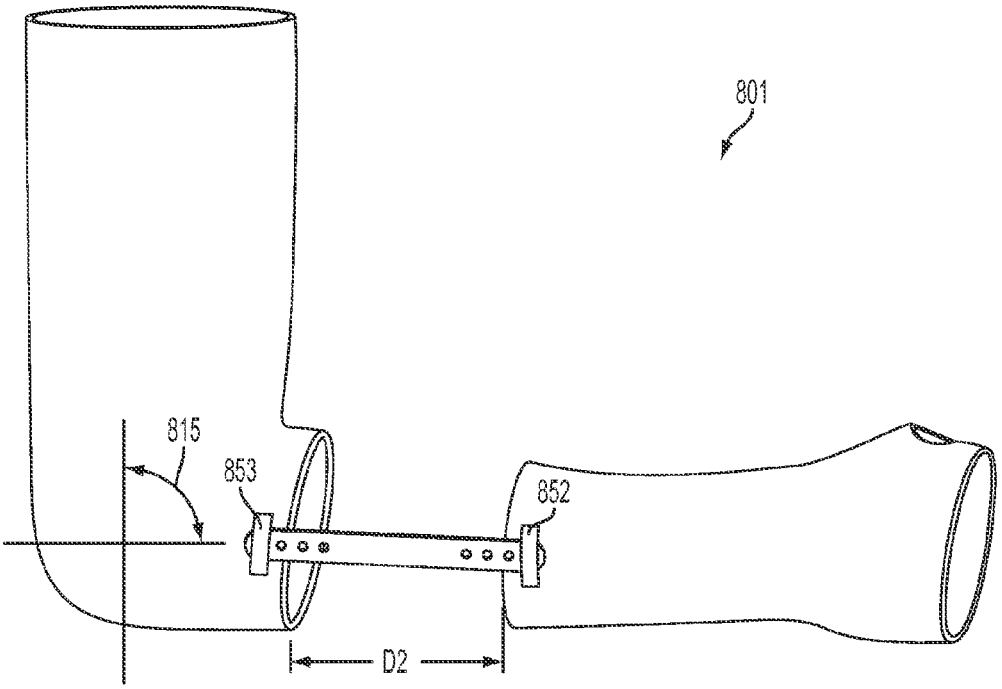
Figure 13A:
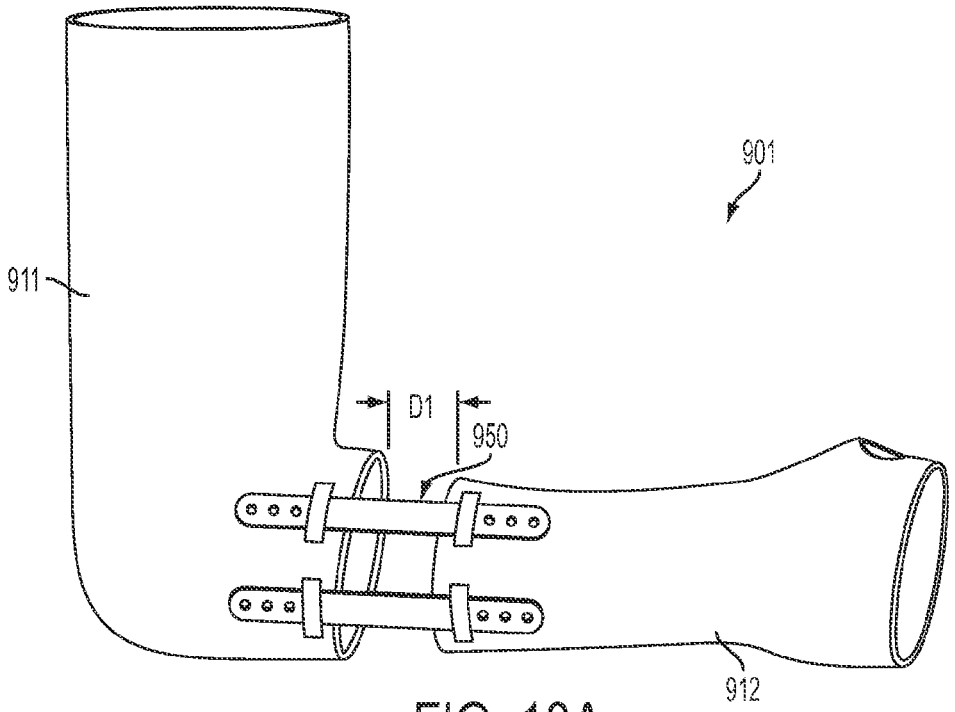
Figure 13B:
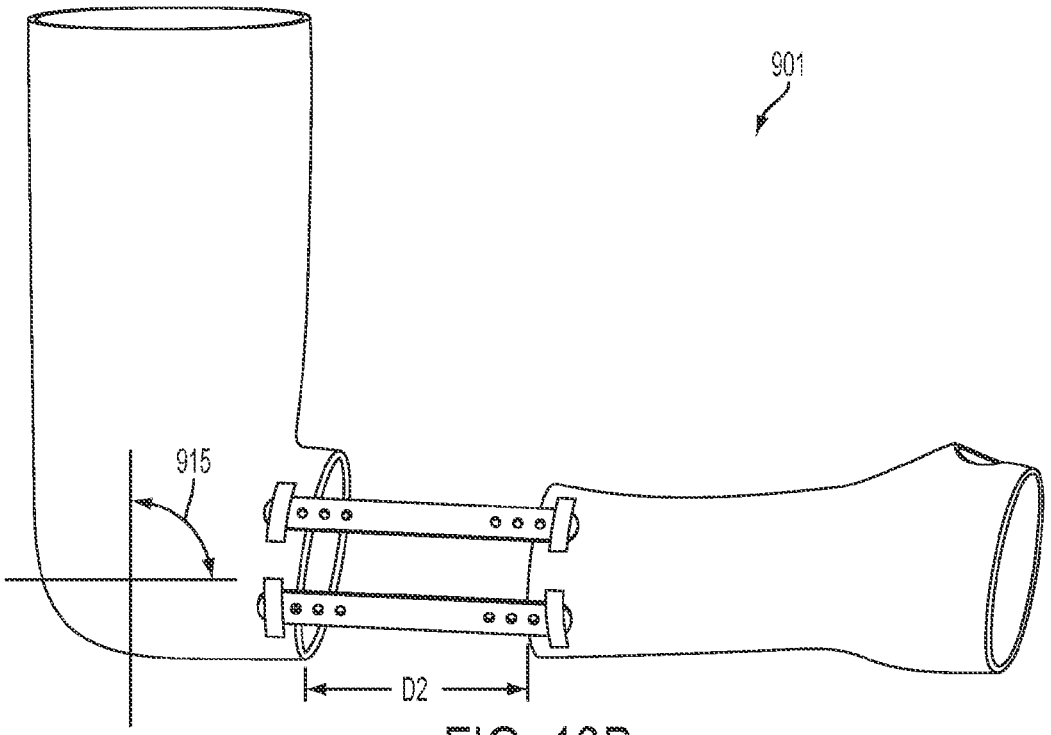
Figure 14A:
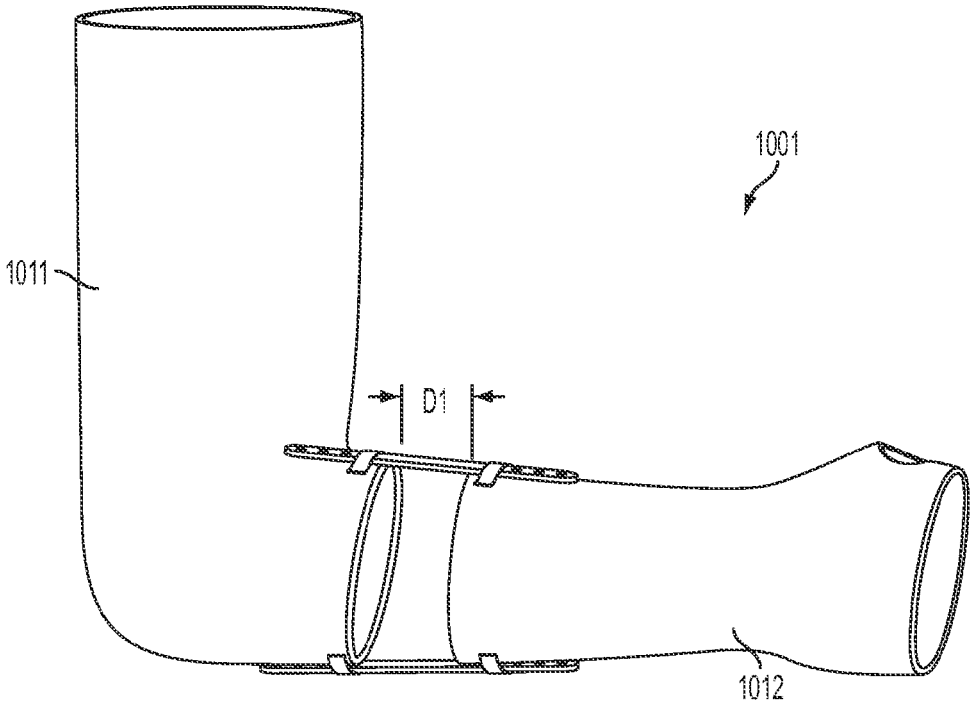
Figure 14B:
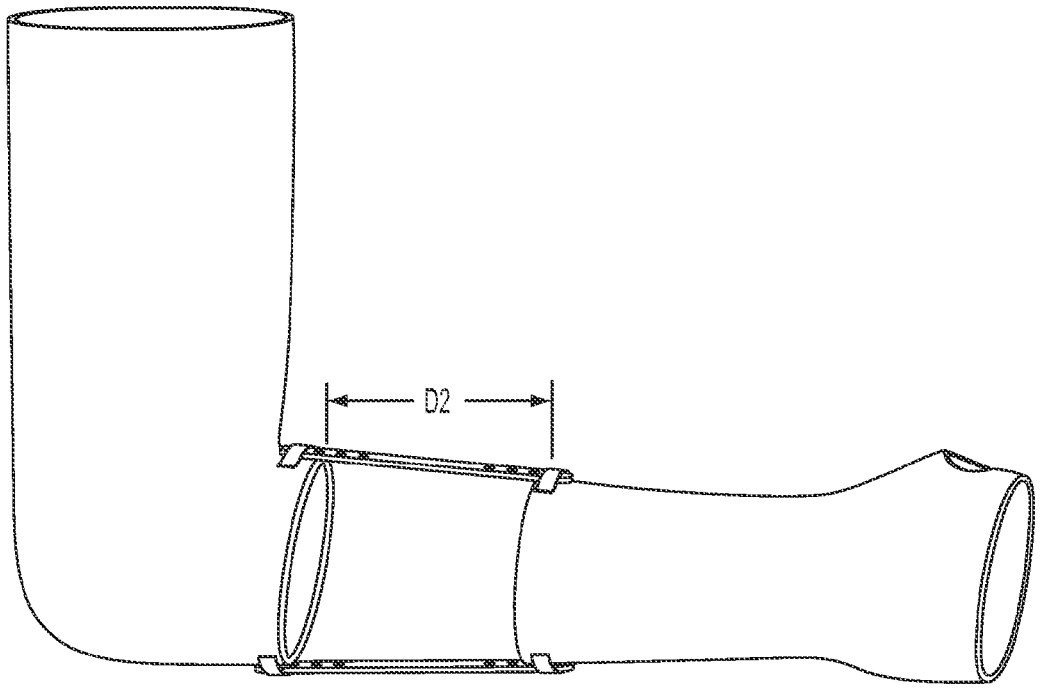
Figure 15A:
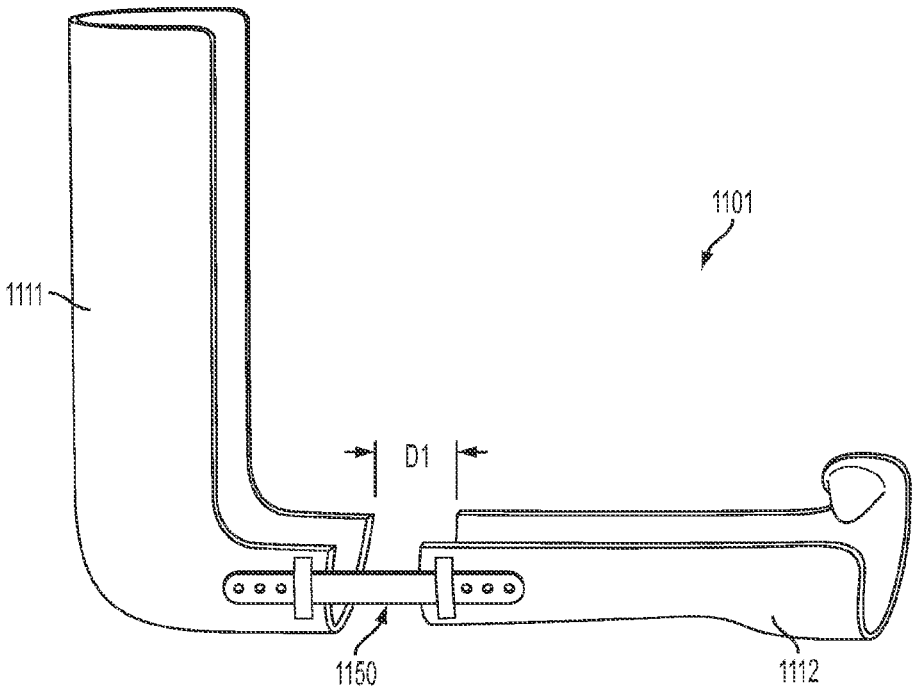
Figure 15B:
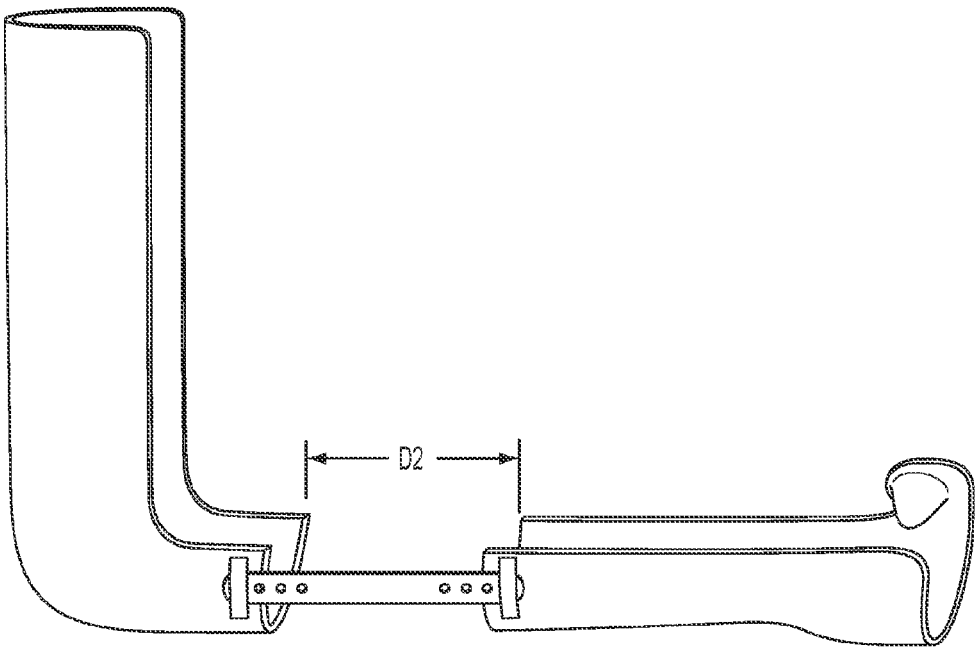
Figure 16A:
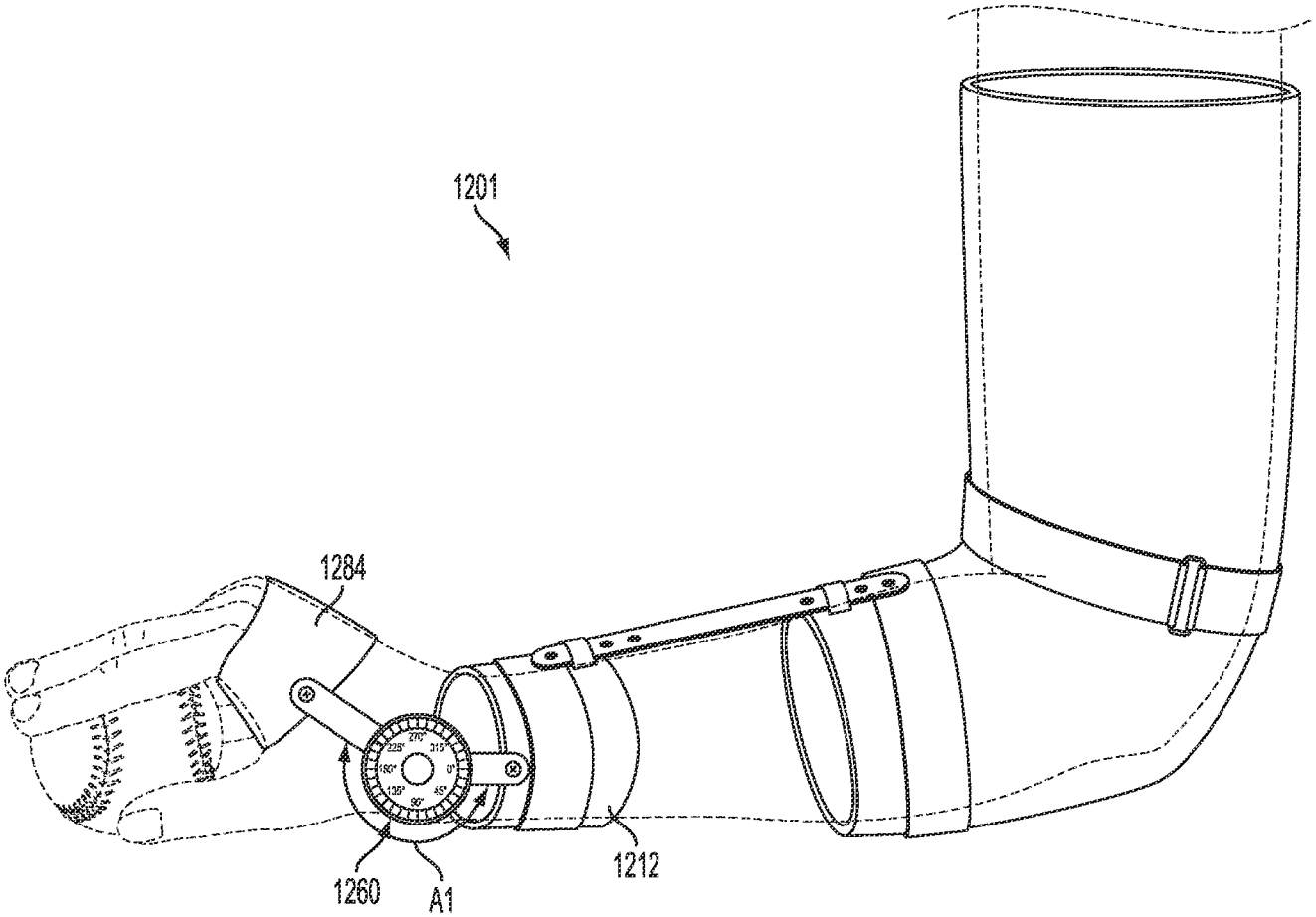
Figure 16B:
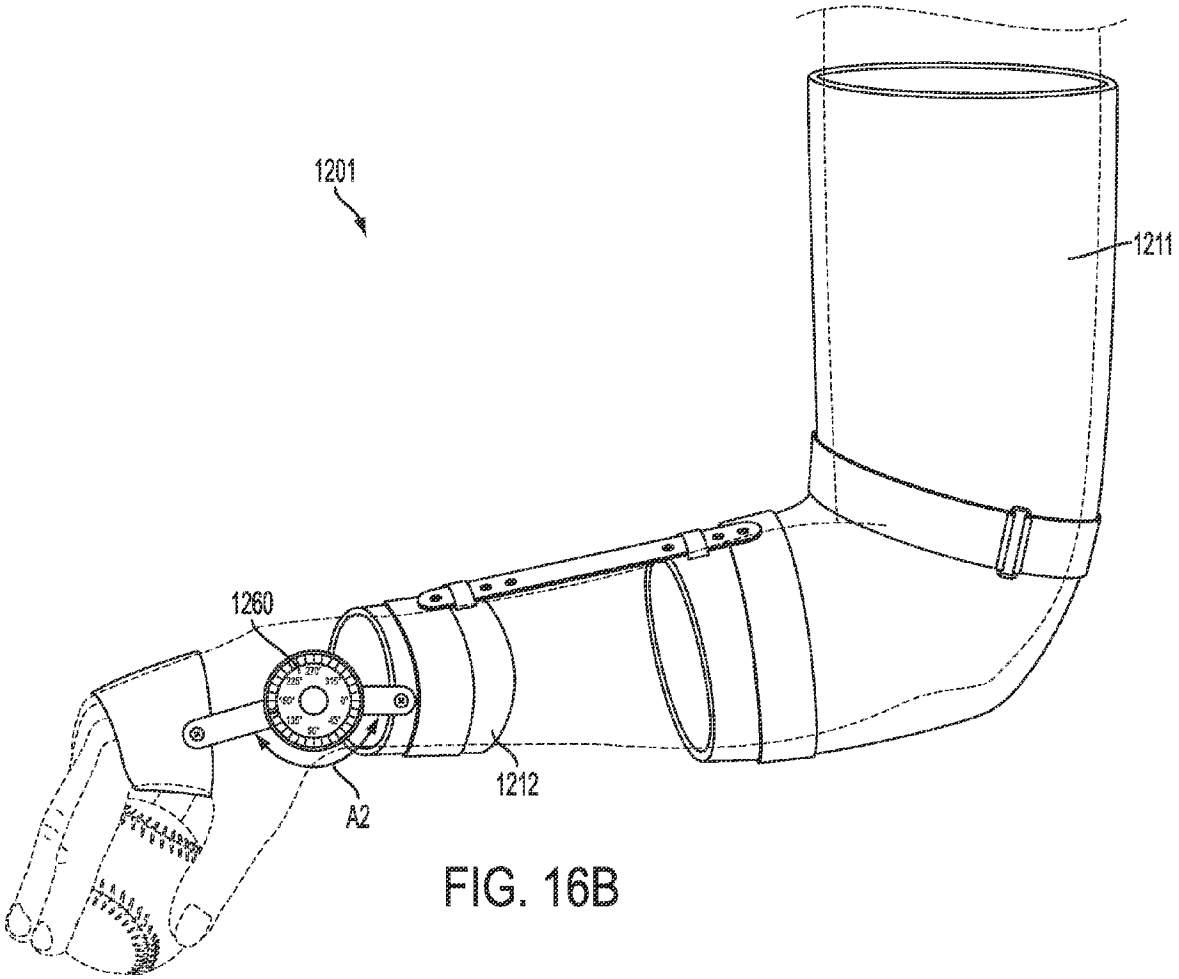
Figure 16C:
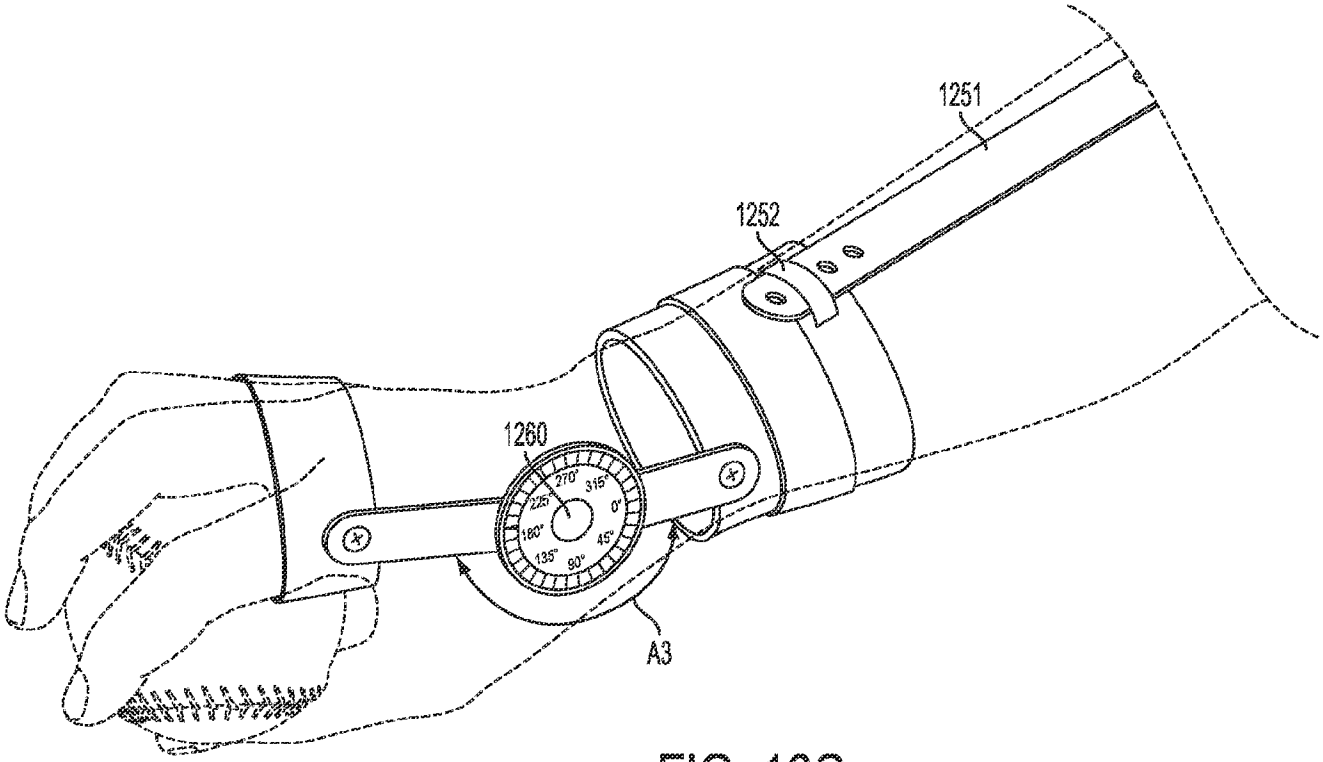
Figure 16D:
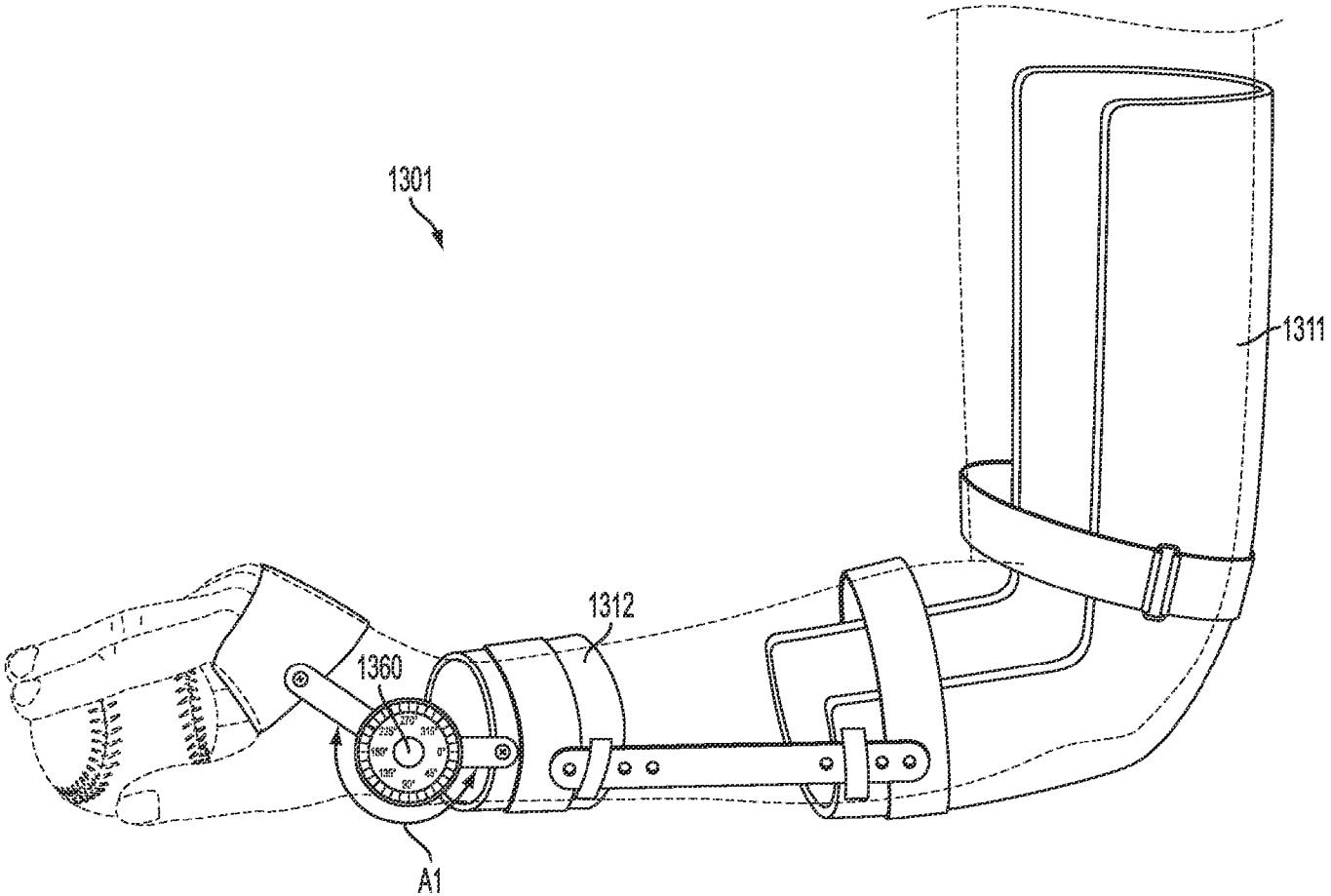
Figure 16E:
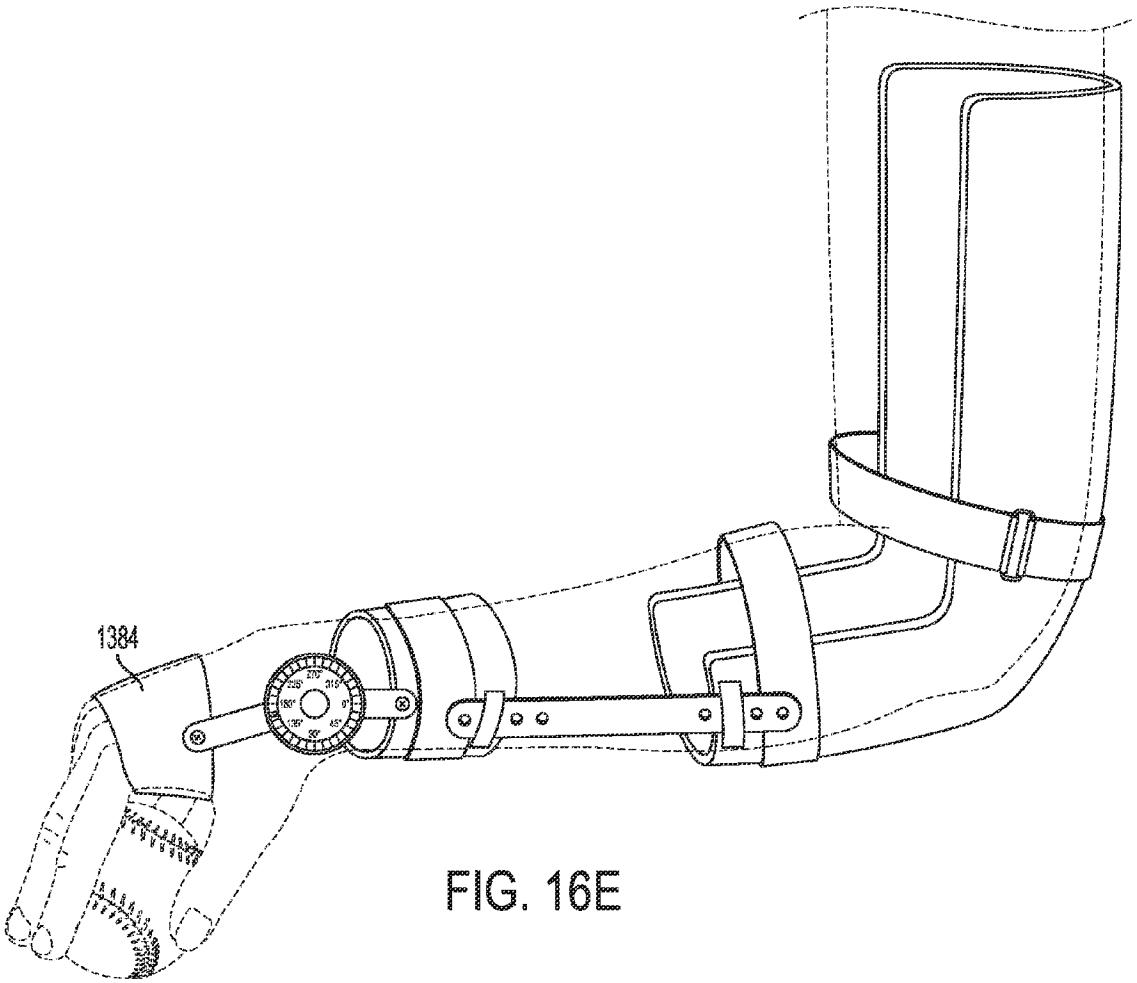
Figure 16F:
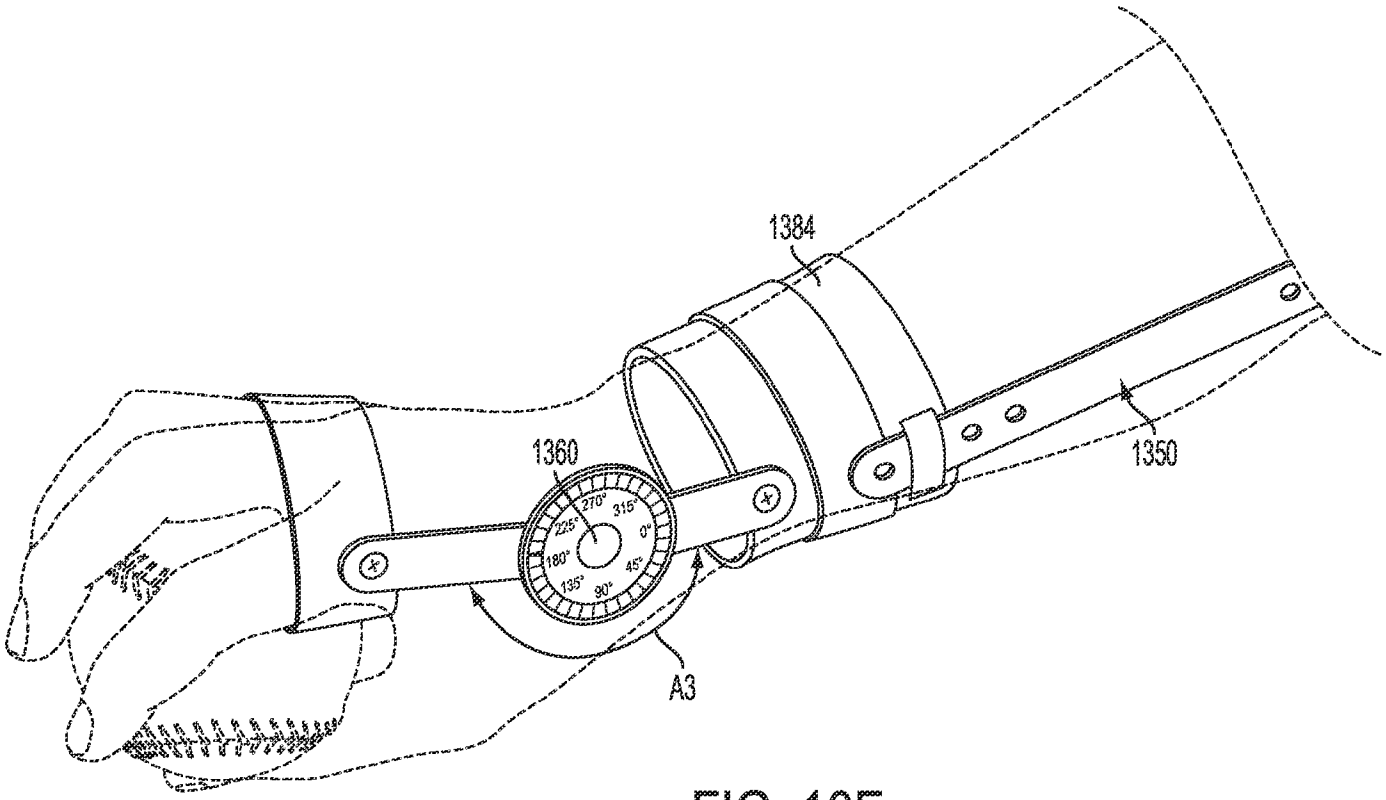
Figure 17A:
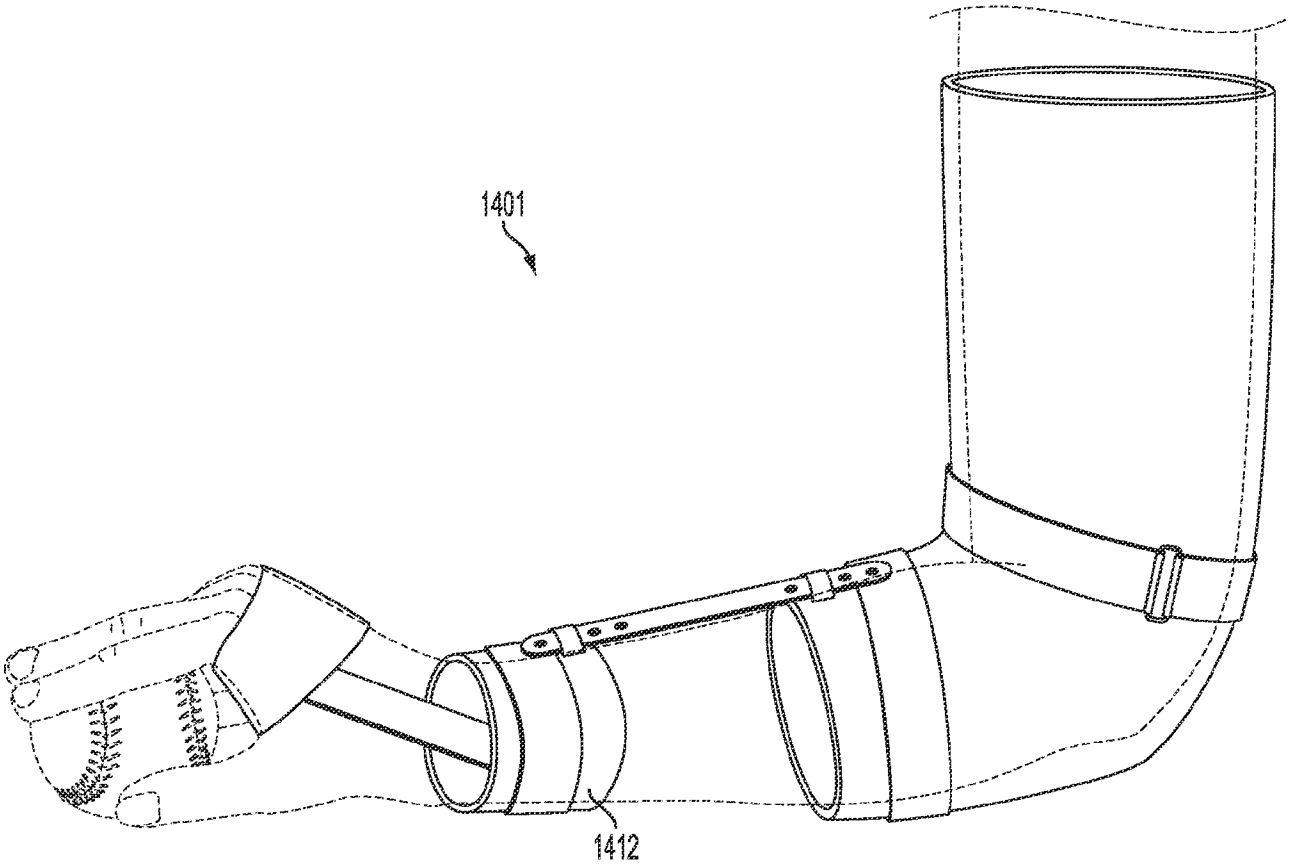
Figure 17B:
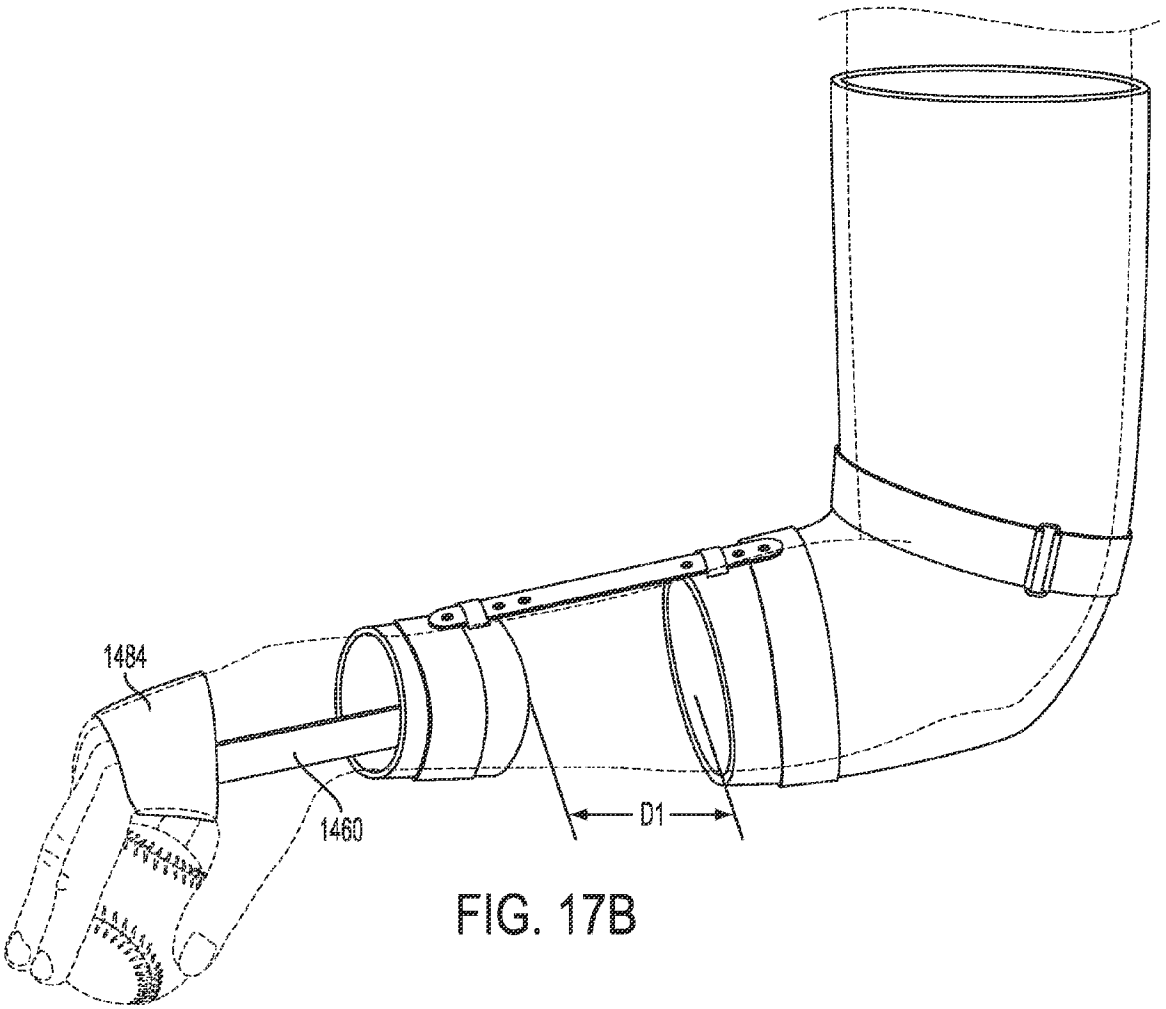
Figure 17C:
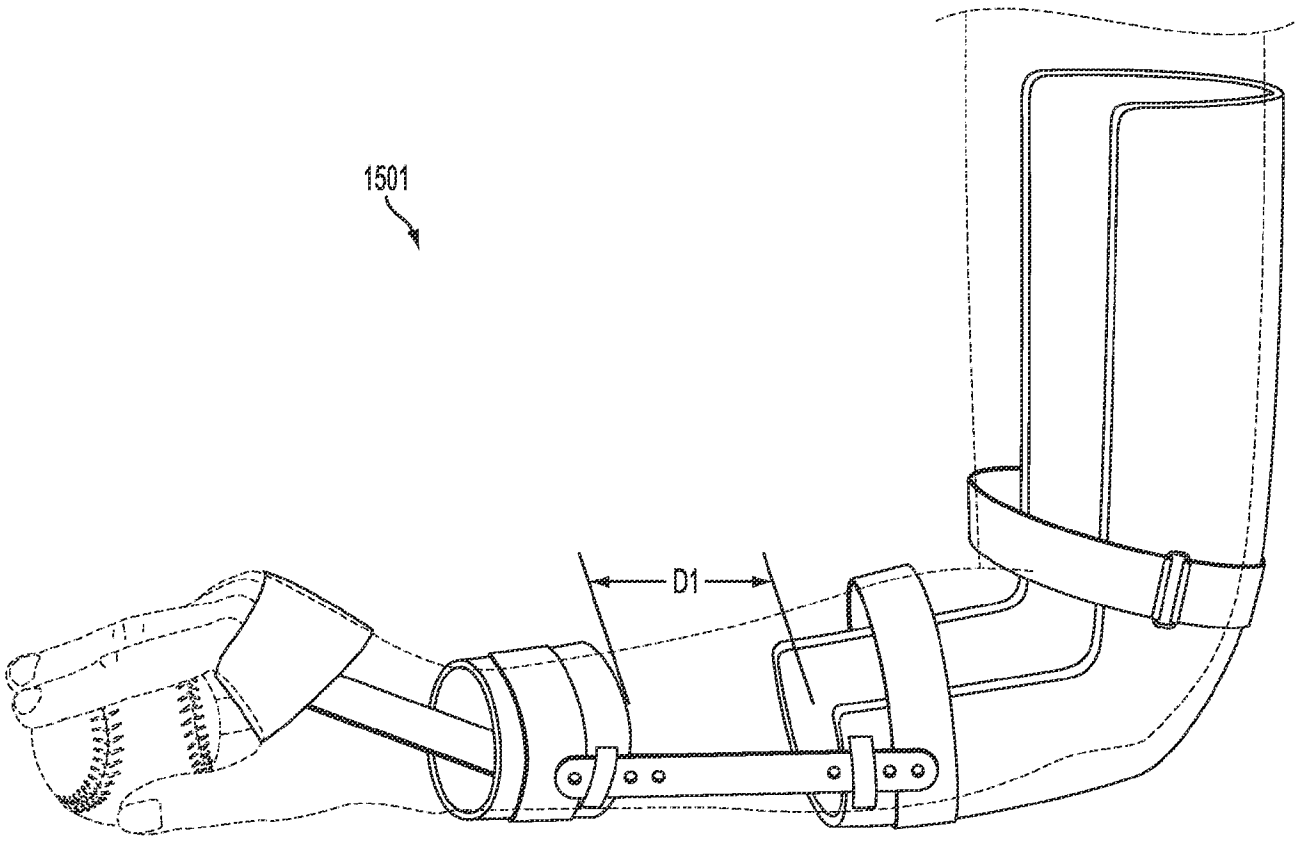
Figure 17D:
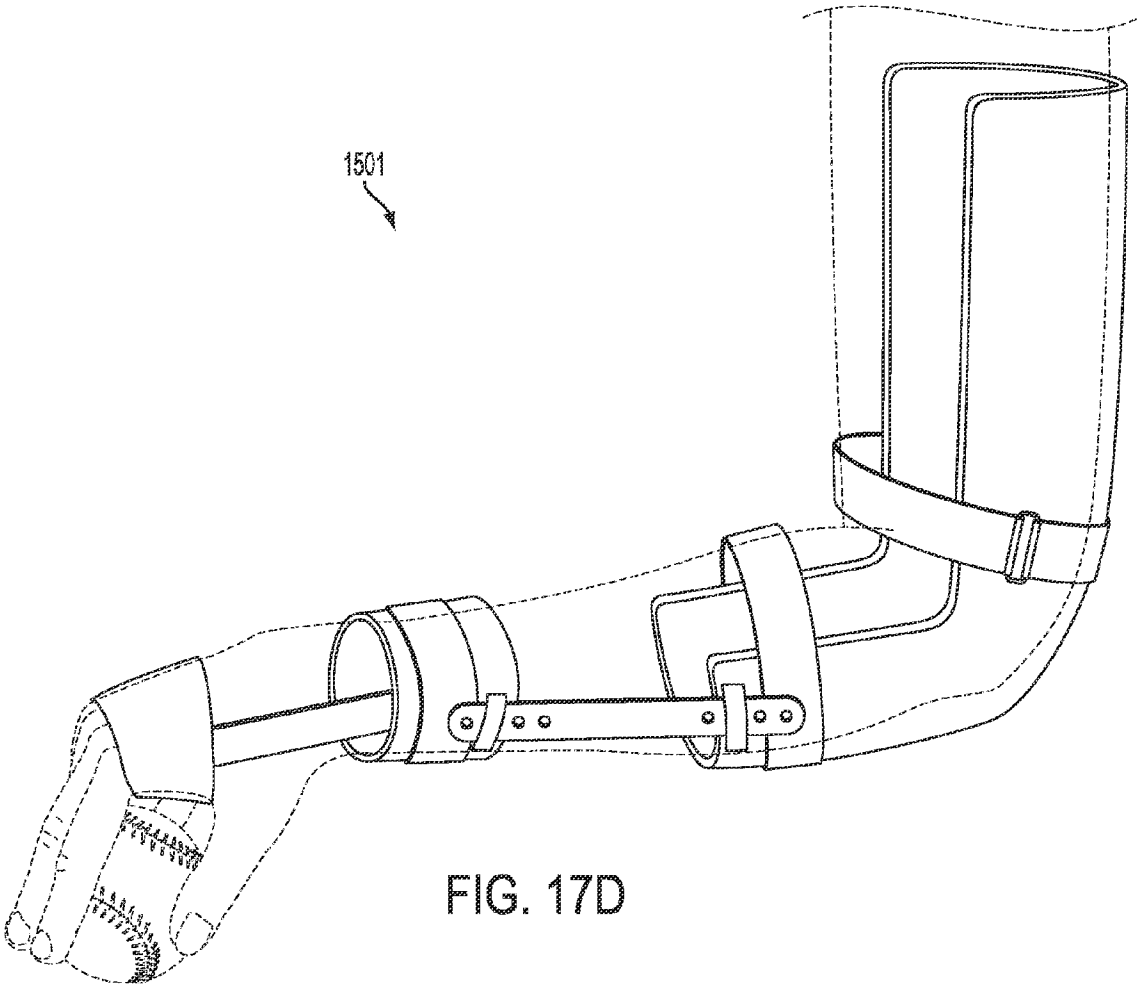
Figure 18A:
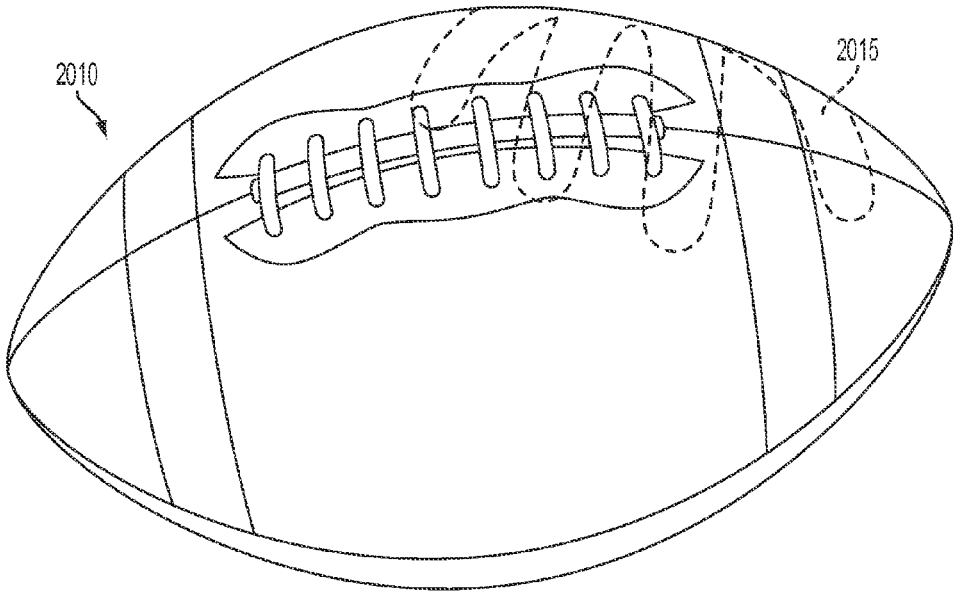
Figure 18B:
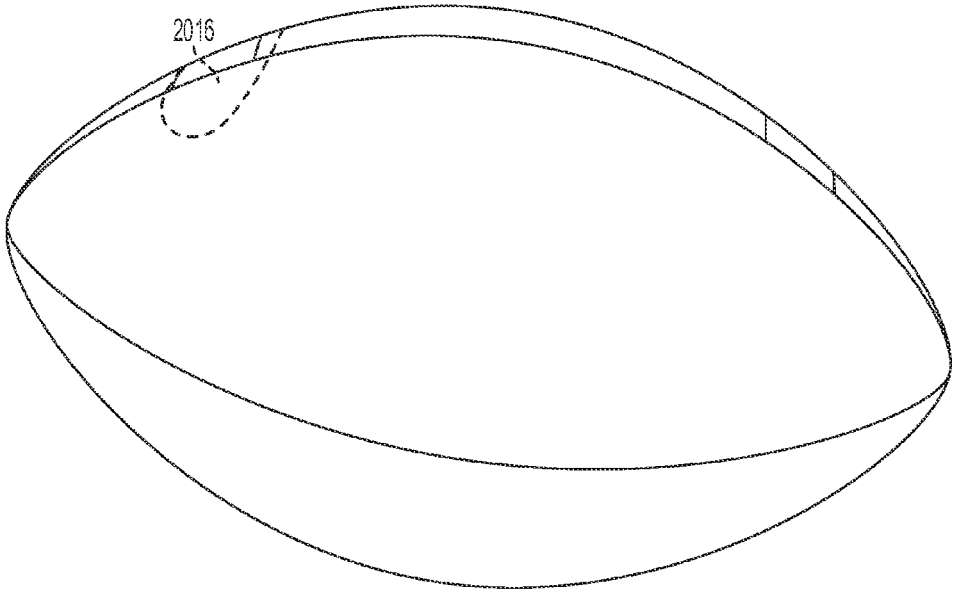
Figure 19B:
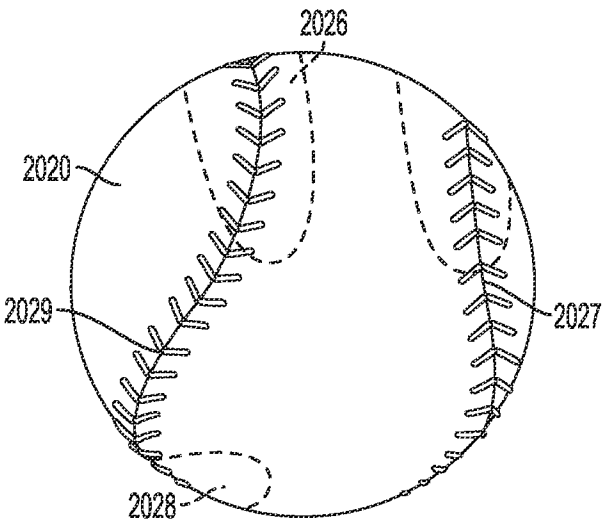
Figure 19A:
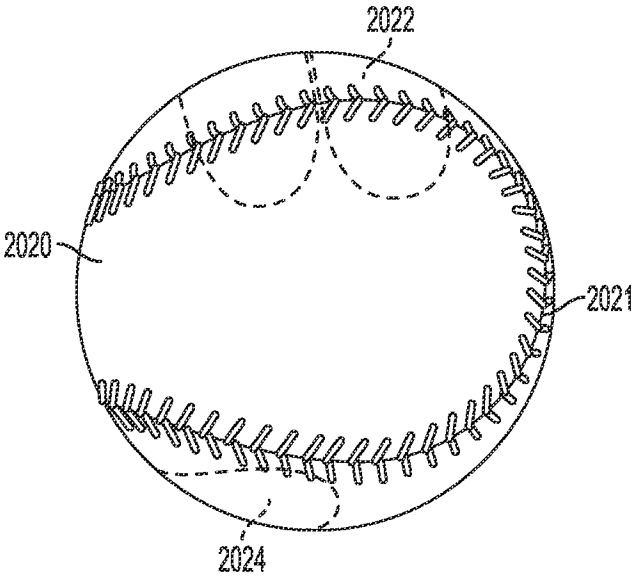

FIG. 3 is a front perspective view of a body portion 10 of the apparatus 1 of FIGS. 1 and 2;

FIG. 4A is a back view of a portion of the apparatus 1 of FIG. 1, further illustrating a wedge portion 13 positioned within a user's palm 8;

FIG. 4B is a side (e.g., end) view of the portion of the apparatus 1 shown in FIG. 4A;

FIG. 5A is a front view of a training apparatus 101 according to a second exemplary embodiment of the invention, illustrated in a first, retracted orientation;

FIG. 5B is a front view of the training apparatus 101 of FIG. 5A, illustrated in a second, extended orientation;

FIG. 5C is an exploded illustrative view of an extension mechanism 150 of the apparatus 101 of FIGS. 5A & 5B;

FIG. 6 is a front view of a training apparatus 201 according to a third exemplary embodiment of the invention;

FIG. 7 is a front view of a training apparatus 301 according to a fourth exemplary embodiment of the invention;

FIG. 8 is a front view of a training apparatus 401 according to a fifth exemplary embodiment of the invention;

FIG. 9 is a front view of a training apparatus 501 according to a sixth exemplary embodiment of the invention;

FIG. 10 is a front view of a training apparatus 601 according to a seventh exemplary embodiment of the invention;

FIG. 11 is a front view of a training apparatus 701 according to an eighth exemplary embodiment of the invention;

FIG. 12A is a front view of a training apparatus 801 according to a ninth exemplary embodiment of the invention, illustrated in a first, retracted orientation;

FIG. 12B is a front view of the training apparatus 801 of FIG. 12A, illustrated in a second, extended orientation;

FIG. 13A is a front view of a training apparatus 901 according to a tenth exemplary embodiment of the invention, illustrated in a first, retracted orientation;

FIG. 13B is a front view of the training apparatus 901 of FIG. 13A, illustrated in a second, extended orientation;

FIG. 14A is a front view of a training apparatus 1001 according to an eleventh exemplary embodiment of the invention, illustrated in a first, retracted orientation;

FIG. 14B is a front view of the training apparatus 1001 of FIG. 14A, illustrated in a second, extended orientation;

FIG. 15A is a front view of a training apparatus 1101 according to a twelfth exemplary embodiment of the invention, illustrated in a first, retracted orientation;

FIG. 15B is a front view of the training apparatus 1101 of FIG. 15A, illustrated in a second, extended orientation;

FIG. 16A is a front view of a training apparatus 1201 according to a thirteenth exemplary embodiment of the invention, illustrated in a first orientation;

FIG. 16B is a front view of the training apparatus 1201 of FIG. 16A, illustrated in a second orientation;

FIG. 16C is a front view of a portion of the training apparatus 1201 of FIGS. 16A-B, further illustrating a wrist pivot assembly 1260;

FIG. 16D is a front view of a training apparatus 1301 according to a fourteenth exemplary embodiment of the invention, illustrated in a first orientation;

FIG. 16E is a front view of the training apparatus 1301 of FIG. 16D, illustrated in a second orientation;

FIG. 16F is a front view of a portion of the training apparatus 1301 of FIGS. 16D-E, further illustrating a wrist pivot assembly 1360;

FIG. 17A is a front view of a training apparatus 1401 according to a fifteenth exemplary embodiment of the invention, illustrated in a first orientation;

FIG. 17B is a front view of the training apparatus 1401 of FIG. 17A, illustrated in a second orientation;

FIG. 17C is a front view of a training apparatus 1501 according to a sixteenth exemplary embodiment of the invention, illustrated in a first orientation;

FIG. 17D is a front view of the training apparatus 1501 of FIG. 17A, illustrated in a second orientation;

FIGS. 18A and 18B are perspective views of a football 2010 for use in conjunction with any of the disclosed embodiments of the invention; and FIGS. 19A and 19B are perspective views of a baseball 2020 for use in conjunction with any of the disclosed embodiments of the invention.

DETAILED DESCRIPTION OF THE INVENTION

Embodiments of the present invention now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements.

Unless otherwise defined, all technical and scientific terms used herein have the same meaning as commonly understood by one of ordinary skill in the art to which this invention belongs. The terminology used in the description is for describing particular embodiments only and is not intended to be limiting to embodiments of the present invention. As used in the description, the singular forms "a," "an," and "the" are intended to include the plural forms as well, unless the context clearly indicates otherwise. The term "or" is used herein in both the alternative and conjunctive sense, unless otherwise indicated. The terms "illustrative" and "exemplary" are used to be examples with no indication of quality level.

Unless otherwise indicated, all numbers expressing quantities of dimensions such as length, width, height, and so forth as used in the description are to be understood as being modified in all instances by the term "about." Accordingly, unless otherwise indicated, the numerical properties set forth in the description are approximations that may vary depending on the desired properties sought to be obtained in embodiments of the present invention. Notwithstanding that the approximate numerical ranges and parameters setting forth the broad scope of embodiments of the present invention, the numerical values set forth in the specific examples are reported as precisely as possible. Any numerical values, however, inherently contain certain errors necessarily resulting from error found in their respective measurements.

Structure of Various Embodiments of the Invention

First Embodiment 1

Reference is now made to FIG. 1, which illustrates a training apparatus 1 comprising a body portion 10, a first flexible portion 20, and a second flexible portion 30. The body portion 10, according to various embodiments, may include a first portion 11, a second portion 12, and a third portion 13. In certain embodiments, the body portion 10 may be constructed from a plastic material such as the non-limiting examples of polycarbonate, polyvinyl chloride (vinyl), polyethylene terephthalate (PET), low or high density polyethylene (LDPE or HDPE), or any combination or alternative of the same, as known or understood in the arts. In other embodiments, the body portion 10, including the first, second and third portions 11, 12, and 13, may be constructed from any of a variety of materials as commonly known or understood in the art as having a desired degree of rigidity sufficient to hold or maintain a user's arm (e.g., 5 in FIG. 2) in place throughout the performance of a throwing motion.

In various embodiments, the first portion 11 of the body portion 10 may be configured to receive at least a portion of a user's arm 5, as may be seen, for example, in at least FIG. 2. Indeed, in that particularly illustrated embodiment, the first portion 11 is configured to receive only a back portion (e.g., a portion adjacent a user's tricep muscle) of the user's upper arm. In other embodiments, the first portion 11 may be configured to receive substantially more or substantially less of a portion of the user's upper arm as that depicted in FIG. 2. In still other embodiments, the first portion 11 may be configured to substantially surround (e.g., almost fully encircle, but entirely so) the user's upper arm, such as will be discussed in further detail below with regard to additional embodiment variations.

In various embodiments, the second portion 12 of the body portion 10 is similarly configured to receive at least a portion of a user's arm 5, as may be seen, for example, in at least FIG. 2. Indeed, in that particularly illustrated embodiment, the second portion 12 is configured to receive only a lower or inner portion of the user's forearm. In other embodiments, the second portion 12 may be configured to receive substantially more or substantially less of a portion of the user's forearm as that depicted in FIG. 2. In still other embodiments, the second portion 12 may be configured to substantially surround (e.g., almost fully encircle, but not entirely so) the user's forearm, such as will be discussed in further detail below with regard to additional embodiment variations.

In various embodiments, the third portion 13 of the body portion 10 is configured to receive at least a portion of a user's palm 8, as generally shown in FIGS. 2 and 4A-B. In certain embodiments, as can be seen from FIGS. 3 and 4B, in particular, the third portion 13 may include at least a portion that is substantially wedge or dome-shaped. Such a structure enables the third portion 13 to restrict a user's ability to place his or her palm onto the surface of sporting equipment (e.g., a football) when making the throwing motion. Notably, any such placement of the palm onto the surface of the equipment may detract from the quality of user's throwing technique.

As is further evident from FIG. 4B, according to various embodiments, the wedge or dome-shaped portion of the third portion 13, as discussed above, may be configured to rest against a portion of the user's palm located between the user's two middle-most fingers, when viewed from the perspective of, for example, FIG. 4B. This configuration ensures maximum spacing of the user's palm from the body portion 10 during use. While the third portion 13 according to certain of the illustrated embodiments has been described herein as being wedge or dome-shaped in structure, any of a variety of structural alternatives could be envisioned, as commonly known and understood in the art, provided such are configured to similarly space the user's arm from the body portion 10.

Returning to FIG. 1, the body portion 10 according to various embodiments is configured such that its first portion 11 and second portion 12 form an angle 15 that forms a substantially 90 degree angle between the respective portions, 11 and 12. In other embodiments, the angle 15 may be in a range from about 80 to 100 degrees. In still other embodiments, the angle 15 may be anywhere in a range from about 60 to 120 degrees, depending on the requirements of a user, provided the body portion 10 substantially prevents any undesirable flexion of the user's elbow during the throwing motion. Notably, the fixed angular orientation of the body portion 10, in various embodiments, ensures that the user maintains the proper throwing technique through the duration of the throwing motion. In particular, in certain embodiments, maintaining the user's arm at a substantially 90 degree angle 15 adjacent the elbow ensures that the user does not inadvertently straighten or extend his or her forearm immediately prior to or during the release of a sports equipment (e.g., a football).

Referring now to FIGS. 1 and 2, the training apparatus 1 according to various embodiments may include at least a first flexible portion 20 and a second flexible portion 30. In certain embodiments, the first flexible portion 20 may include at least an arm wrap portion 21, a hand wrap portion 22, and a plurality of connector portions 25. In certain embodiments, the first flexible portion 20 may be constructed from a flexible material such as for instance the non-limiting example of neoprene. In other embodiments, the first flexible portion 20 may be constructed from a variety of different flexible and/or stretchable materials, as commonly known or understood in the art.

In various embodiments, the arm wrap portion 21 of the first flexible portion 20 is configured to substantially engage with at least a portion of a user's forearm 5. In certain embodiments, as shown in FIG. 2, the arm wrap portion 21 substantially engages an upper portion of the user's forearm not otherwise engaged by any portion of the body portion 10, as described and discussed above. In other embodiments (not shown), the arm wrap portion 21 may substantially engage any portion of the user's forearm not otherwise engaged by any portion of the body portion 10 such that, in any of those embodiments, the arm wrap portion 21 provides a means for fully encircling the user's forearm during use of the training apparatus 1.

The hand wrap portion 22, according to various embodiments may be formed as a continuous piece of material together with the arm wrap portion 21 (as shown in FIG. 2), while in additionally envisioned embodiments (not shown), the hand wrap portion and the arm wrap portion may be separate pieces. In those embodiments, the hand wrap portion 22 may or may not be formed from substantially the same material as the arm wrap portion 21, as described above.

The hand wrap portion 22, according to various embodiments, may further include a first opening configured to receive a user's thumb 9 and a second opening configured to receive a user's fingers and palm 8. In certain embodiments, the first and the second opening may be substantially formed in its entirety by the hand wrap portion 22; however, in other embodiments, such as that illustrated in FIG. 2, at least a portion of the second opening may be formed by not only the hand wrap portion 22 but also the third portion 13 of the body portion 10.

In various embodiments, the first flexible portion 20 may include a plurality of connector portions 25 that enable selective attachment of the first flexible portion to the body portion 10. In certain embodiments, such as, for example, that illustrated in FIG. 2, the connector portions 25 are patches having at least a portion formed from a sticky or adhesive material, such as the non-limiting example of VELCRO®, as commonly understood to refer to any fabric-based hook and loop fastener. In other embodiments, the connector portions 25 may be formed from any of a variety of material s (e.g., magnets, clips, hooks, or the like), provided such serve to adhere and retain the first flexible portion 20 to the body portion 10, when so desirable.

While FIG. 2 illustrates an embodiment having three connector portions 25 located adjacent one side of the first flexible portion 20, any number and/or orientation of the connector portions 25 may be envisioned, provided they sufficiently adhere the first flexible portion 20 to the body portion 10 in a manner that snugly retains the user's arm 5 therebetween. Further, while FIG. 2 depicts an embodiment having square-shaped connector portions 25, any of a variety of shapes and/or sizes of the connector portions may be included in additional embodiments, as commonly known and understood in the art.

Referring back to FIGS. 1 and 2, the training apparatus 1 according to various embodiments may include a second flexible portion 30. In certain embodiments, the second flexible portion 30 is constructed from a material and configured substantially similar to the first flexible portion 20, as described in detail above with reference to at least FIGS. 1-4B. However, in other embodiments, the second flexible portion 30 may be constructed from a material and/or configured substantially different from the first flexible portion 20. For example, in certain embodiments, the second flexible portion 30 may be constructed from a flexible material such as for instance the non-limiting example of neoprene. In other embodiments, the second flexible portion 30 may be constructed from a variety of different flexible and/or stretchable materials, as commonly known or understood in the art.

In various embodiments, the second flexible portion 30 may include at least an arm wrap portion 31 and at least one connector portion 32. In certain embodiments, the arm wrap portion 31 and the connector portion 32 are constructed and configured substantially similar to the arm wrap portion 21 and the connector portions 25 discussed above with respect to FIG. 2 and the first flexible portion 20. However, in other embodiments, the arm wrap portion 31 and the connector portion 32 may be constructed and/or configured in a substantially different manner from the first flexible portion 20. For example, in certain embodiments such as that depicted in FIG. 2, the arm wrap portion 31 is substantially shorter in length than the arm wrap portion 21, while the connector portion 32 is must larger relative to the connector portions 25. Oftentimes, these distinctions are due to the arm wrap portion 31's retention of a user's upper arm versus the arm wrap portions 21's retention of a user's forearm, as discussed in further detail below.

In various embodiments, the arm wrap portion 31 of the second flexible portion 30 is configured to substantially engage with at least a portion of a user's upper arm 5. In certain embodiments, as shown in FIG. 2, the arm wrap portion 31 substantially engages an front portion (e.g., adjacent a user's bicep muscle) of the user's upper arm not otherwise engaged by any portion of the body portion 10, as described and discussed above. In other embodiments (not shown), the arm wrap portion 31 may substantially engage any portion of the user's upper arm not otherwise engaged by any portion of the body portion 10 such that, in any of those embodiments, the arm wrap portion 31 provides a means for fully encircling the user's upper arm during use of the training apparatus 1.

In various embodiments, the second flexible portion 30 may include at least one connector portion 32 that enables selective attachment of the second flexible portion to the body portion 10. In certain embodiments, such as, for example, that illustrated in FIG. 2, the connector portion 32 is at least one patch having at least a portion formed from a sticky or adhesive material, such as the non-limiting example of VELCRO®, as commonly understood to refer to any fabric-based hook and loop fastener. In other embodiments, the connector portion 32 may be formed from any of a variety of materials (e.g., magnets, clips, hooks, or the like), provided such serve to adhere and retain the second flexible portion 30 to the body portion 10, when so desirable.

While FIG. 2 illustrates an embodiment having only one connector portion 32 located adjacent one side of the second flexible portion 30, any number and/or orientation of the connector portions 32 may be envisioned, provided they sufficiently adhere the second flexible portion 30 to the body portion 10 in a manner that snugly retains the user's arm 5 therebetween. Further, while FIG. 2 depicts an embodiment having a substantially square-shaped connector portion 32, any of a variety of shapes and/or sizes of the connector portions may be included in additional embodiments, as commonly known and understood in the art.

Returning again to FIG. 1, in the illustrated embodiment, the second flexible portion 30 fully encircles at least a portion of the body portion 10, while in comparison, the first flexible portion 20 merely attaches to the body portion 10. It should be envisioned in additional embodiments, that one or both of the flexible portions, 20 and 30, could encircle the body portion, or alternatively attach to the body portion without encircling the same.

As may be best understood from FIG. 3, the body portion 10 of the training apparatus 1 may include a cushion or liner 16 for the comfort of its users. In certain embodiments, the cushion or liner 16 may be formed from any of a variety of materials, as commonly known or understood in the art to provide resistance to impact, absorption of sweat, and/or general comfort. For example, in various embodiments, the cushion or liner 16 may be formed from one or more of the non-limiting examples of polyurethane foam, latex foam, slab foam, fiber batting-wrapped foam cushions, fibrous or bonded polyester batting, cotton felt, or the like.

Further, although not shown in FIG. 3, the cushion or liner 16, according to various embodiments may encompass the entirety of the body portion 10 or only certain portions of the body portion (e.g., the forearm and upper arm) commonly known and understood to be predisposed to discomfort, sweat, or injury during athletic activities. In any of those embodiments, the cushion or liner 16 may include certain areas having thicker padding than others, with some areas, in certain embodiments, having not padding at all, if desirable. In other embodiments, the cushion or liner 16 may complement weights and/or balances included within the body portion 10 for proper alignment of the user's arm when performing the throwing motion. Such weights and/or balances may be included adjacent any portion of the body portion 10, as desirable according to various embodiments, and may be included in conjunction with or in place of the cushion or liner 16, as discussed above and illustrated in at least FIG. 3.

Turning to FIGS. 4A and 4B, according to various embodiments, the body portion 10 may include a third portion 13 (as described above) a ring portion 41 and an elongate strap 42. In certain embodiments, as best understood from FIG. 4A, the ring portion 41 is configured to substantially surround a user's thumb 9 during use of the apparatus 1. In other embodiments, the ring portion 41, although similarly configured may be constructed as a portion of the first flexible portion 20 rather than as part of the body portion. In any of these various embodiments, the ring portion 41 may be operatively connected to the third portion 13 via the elongate strap 42. According to various embodiments, the elongate strap 42, ring portion 41, and the third portion 13 cooperate to ensure proper placement of a user's thumb 9 relative to the user's fingers on a piece of sporting equipment (e.g., a football).

With reference to FIG. 4B in particular, according to various additional embodiments of the training apparatus 1, a finger portion 40 may be further provided that retains a user's fingers much like the ring portion 41 (discussed above) retains the user's thumb during use of the apparatus to improve or perfect throwing technique. In certain of these embodiments, the finger portion 40 (and also the ring portion 41) may be constructed from a variety of materials, such as, for instance, the non-limiting examples of plastic, ceramic, metal, or the like sufficient to substantially retain the user's thumb and fingers during use.

With reference again to FIG. 4B, according to various embodiments of the training apparatus 1, the body portion 10 may be configured to have a thickness 18 that may be sufficiently thin so as to permit a gap between the user's palm and the body portion 10. As discussed above, the wedge or dome-shaped (or other alternatively shaped) portion of the third portion 13 may further increase the gap in certain embodiments, as also evident from FIG. 4B. In certain embodiments, the first flexible portion 20 may likewise have a thickness 28 that permits a gap to be formed between the user's palm and at least a portion of the first flexible portion 20 adjacent the third portion 13. In these embodiments, the thicknesses, 18 and 28 may be substantially the same (see again FIG. 4B), while in other embodiments (not shown) the thicknesses may be substantially different, as desirable.

Second Embodiment 101

While the various embodiments of the training apparatus 1 illustrated in FIGS. 1-4B comprise a body portion 10 constructed from a single continuous piece of material, it should be appreciated that in still other embodiments, the body portion 10 can be constructed from any number of desired separate pieces of material. As a non-limiting example, a training apparatus 101, as shown in FIG. 5A, may include a body portion 110 that comprises a first portion 111, a second portion 112, and a third portion 114.

Referring still to the embodiment illustrated in FIG. 5A, the first portion 111 may be configured to receive at least a portion (e.g., a rear portion) of a user's upper arm (not shown), while the second portion 112 may be configured to receive at least a portion (e.g., a bottom portion) of a user's forearm (also not shown). The third portion 114, according to certain embodiments such at that illustrated in FIG. 5A, is positioned substantially between the first portion 111 and the second portion 112. Further, the third portion 114, according to the illustrated embodiment, may be configured such that it forms an angle 115 that forms a substantially 90 degree angle. In other related embodiments, the angle 115 may be in a range from about 80 to 100 degrees. In still other un-illustrated embodiments, the angle 115 may be anywhere in a range from about 60 to 120 degrees, depending on the requirements of a user, provided the third portion 114 substantially prevents any undesirable flexion of the user's elbow during the throwing motion.

As may be seen from FIG. 5C, the body portion 110 may include one or more extension mechanisms 150. According to the illustrated embodiment, such an extension mechanism 150 may comprise a plurality of slots 154 and at least one peg 152. The plurality of slots 154 may each be configured to receive the at least one peg 152, thereby permitting adjustment of the body portion 110. While the extension mechanism 150 of the illustrated embodiment comprises a slot and peg configuration, other embodiments may utilize any of a variety of mechanisms that similarly allow for adjustment of adjacently positioned segments of the body portion 110.

Returning now to FIGS. 5A and 5B, it may be understood that in various exemplary versions of this embodiment, the third portion 114 comprises at least one set of slots 154. In certain embodiments, the slots 154 may be configured to substantially mate with at least one peg 152 located on the first portion 111 and/or the second portion 112 of the body portion 110. In other embodiments, the slots 154 may be located on the first and second portions, while the pegs 152 may be located on the third portion. In still other embodiments, a combination of slots 154 and pegs 152 may be located on at least the third portion 114. In use, the slot and peg configuration of the extension mechanism 150 adjustably connects the first portion 111 and/or the second portion 112 to the third portion 114, thereby permitting the training apparatus 101 to be adjusted as desired based upon a variety of dimensions of users' arms.

In the embodiment illustrated in FIGS. 5A and 5B, the extension mechanism 150 may include two sets of five slots 154, each located at opposing ends of the third portion 114 of the body portion 110 and two pegs 152, one located on one end of the first portion 111 and the second portion 112 of the body portion. As may be understood from these Figures, according to various embodiments, the extension mechanism 150, in this manner permits movement of the training apparatus 101 between a first, retracted orientation having a lower length LL1 and a second, extended orientation having a lower length LL4. Intermediate or additional lengths such as, for example, LL2, LL3, LL5, and the like (not shown), can be envisioned, corresponding generally to sequentially and linearly located slots 154.

Additional variations of the extension mechanism 150 may be envisioned beyond that of the embodiment illustrated in FIGS. 5A and 5B. Such variations may include, for instance, the non-limiting example of a third portion 114 only having one set of slots 154 such that the third portion 114 may be extendably connected only to the second portion 112. In such an embodiment, the training apparatus 101 would permit adjustment of the training apparatus 101 between any of the lengths LL1-LL5 (see LL1 in FIG. 5A and LL4 in FIG. 5B) so as to fit the dimensions of a particular user's forearm, while not permitting any adjustment of the training apparatus relative to a user's upper arm. Alternatively, the third portion 114 could have a peg 152 configured to substantially mate with at least one slot 114 located on the first portion 111, thereby only permitting adjustment of the training apparatus 101 between various lengths relative to the user's upper arm.

In the various versions of the embodiment illustrated in FIGS. 5A-C, the remaining structural features, including, but not limited to, the first flexible portion 120 and the second flexible portion 130, along with their respective first and second elongated wraps, 121 and 131, and connector portions, 125 and 132, may be substantially the same in structure, shape, and/or configuration to the first and second flexible portions, 20 and 30, the first and second elongated wraps, 21 and 31, and the connector portions, 25 and 32, illustrated in FIGS. 1-4B and discussed above. Alternatively, the first flexible portion 120 and the second flexible portion 130 (and their respective sub-elements, as discussed above) can be substantially different in structure, shape, and/or configuration from that of the first and second flexible portions, 20 and 30 (and their respective sub-elements) illustrated in FIGS. 1-4B and discussed above.

Third Embodiment 201

While the various embodiments of the training apparatus 1 illustrated in FIGS. 1-5C and the training apparatus 101 illustrated in FIGS. 5A-C comprise a body portion 10 configured to receive only a portion (e.g., a rear & a bottom portion) of a user's arm, it should be appreciated that in still other embodiments, the body portion 10 can configured to receive the user's arm in any number of desired portions. As a non-limiting example, a training apparatus 201, as shown in FIG. 6 may include a body portion 210 that fully surrounds the user's upper arm and forearm. In still other related embodiments (not shown), the body portion 210 may only fully surround one or the other of the user's upper arm or forearm, in which case such sections would be substantially configured as discussed above with respect to FIGS. 1-5C.

In the embodiment illustrated in FIG. 6, the remaining structural features, including, but not limited to, the first flexible portion 220 and the second flexible portion 230, along with their respective first and second elongated wraps, 221 and 231, and connector portions, 225 and 232, may be substantially the same in structure, shape, and/or configuration to the first and second flexible portions, 20 and 30, the first and second elongated wraps, 21 and 31, and the connector portions, 25 and 32, illustrated in FIGS. 1-4B and discussed above. Alternatively, the first flexible portion 220 and the second flexible portion 230 (and their respective sub-elements, as discussed above) can be substantially different in structure, shape, and/or configuration from that of the first and second flexible portions, 20 and 30 (and their respective sub-elements) illustrated in FIGS. 1-4B and discussed above.

Fourth Embodiment 301

Referring now to FIG. 7, an additional embodiment of a training apparatus 301 is illustrated. In various envisioned versions of this embodiment, the training apparatus 301 comprises a body portion 310 having a first portion 311, a second portion 312, and a third portion 314, substantially similar in structure, shape, and/or configuration to the body portions 110 and 201 discussed above with reference to FIGS. 5A-6. In particular, as in the embodiment shown in FIG. 5A, the body portion 310 may have at least one portion (e.g., the second portion 312 configured to only receive a portion of a user's forearm, while its first portion 311 substantially surrounds the user's upper arm, as did first portion 211 according to various embodiments such as that of FIG. 6. Alternatively, the body portion 310 may be configured so as to substantially surround both the forearm and the upper arm of its user.

Further, the training apparatus 301, as illustrated in FIG. 7, may include an extension mechanism 350 substantially similar in structure, shape, and/or configuration to any of the variety of extension mechanisms 250 discussed above with reference to FIGS. 5A-C. Alternatively, though not illustrated, the extension mechanism 350 may be substantially different in structure, shape, and/or configuration from that illustrated in FIGS. 5A-C and discussed above.

Fifth Embodiment 401

Referring now to FIG. 8, an additional embodiment of a training apparatus 401 is illustrated. In various envisioned versions of this embodiment, the training apparatus 401 may be constructed from a single continuous piece of material (substantially similar to that illustrated in FIGS. 1 and 6 and discussed above), but without any extension mechanisms or flexible portions such as those discussed with reference to at least training apparatuses 1, 201, and 301.

The remaining structural features, including, but not limited to, the first portion 411, the second portion 412, and the angle 415 formed therebetween by the body portion 410 may be substantially the same in structure, shape, and/or configuration to at least the first portion 211, the second portion 212, and the angle 215 formed therebetween by the body portion 210, as illustrated in FIG. 6 and discussed above. Alternatively, in still other embodiments (not shown), the remaining structural features of the training apparatus 401 can be substantially different in structure, shape, and/or configuration from that of similarly functional portions illustrated in any of FIGS. 1-7 and discussed above.

Sixth Embodiment 501

Referring now to FIG. 9, an additional embodiment of a training apparatus 501 is illustrated. In various envisioned versions of this embodiment, the training apparatus 501 may be constructed from at least two body portions 511 and 512 that may be coupled relative to one another by a pivot support assembly 560. In various versions of the illustrated embodiment, the pivot support assembly 560 may include at least a pivot dial 562, and at least two pivot arms 564. In certain embodiments, at least one of the pivot arms 564 serves to couple the pivot dial 562 relative to the first body portion 511 while at least another one of the pivot arms 564 serves to couple the pivot dial 562 relative to the second body portion 512. In other embodiments, the pivot support assembly 560 may include at least four pivot arms 564, two as substantially illustrated in FIG. 9, with two additional pivot arms similarly configured, but located on the opposing side of the user's arm.

In various versions of the embodiment illustrated in FIG. 9, the pivot dial 562 may be selectively locked at a desirable angle 515, depending on the requirements of a user, to substantially prevent any undesirable flexion of a user's elbow during the throwing motion. In the illustrated embodiment, the pivot dial 562 may be selectively locked at an angle 515 of approximately 90 degrees, such that the user's forearm and upper arm are positioned relative to one another at substantially the same (e.g., 90 degree) angle. In other embodiments, the pivot dial 562 may be locked at an angle 515 in a range from about 80 to 100 degrees. In still other embodiments, the angle 515 formed when the pivot dial 562 is locked may be anywhere in a range from about 60 to 120 degrees, depending on the requirements of a user, provided that in any of these various embodiments, the body portions 511 and 512 substantially prevent any undesirable flexion of the user's elbow during the throwing motion.

The remaining structural features, including, but not limited to, the first flexible portion 520, the second flexible portion 530, and the angle 515 formed between the two body portions 511 and 512 may be substantially the same in structure, shape, and/or configuration to at least the first and second flexible portions, 20 and 30, and the angle 15, as illustrated in at least FIGS. 1-7 and discussed above. Alternatively, in still other embodiments (not shown), the remaining structural features of the training apparatus 501 can be substantially different in structure, shape, and/or configuration from that of similarly functional portions illustrated in any of FIGS. 1-7 and discussed above.

Seventh Embodiment 601

Referring now to FIG. 10, an additional embodiment of a training apparatus 601 is illustrated. In various envisioned versions of this embodiment, the training apparatus 601 may be constructed from at least two body portions 611 and 612 that may be coupled relative to one another by a pivot support assembly 660 substantially similar in structure, shape, and/or configuration to that illustrated in at least FIG. 9 and discussed above. Indeed, in at least the illustrated version of this embodiment, the primary difference between training apparatuses, 601 and 501, lies in that at least one of the first and second body portions 611 and 612 of the apparatus in FIG. 10 substantially surrounds the entire arm of a user. In contrast, the first and second body portions 511 and 512, may be configured so as to receive only a portion (e.g., a back and lower portion) of a user's arm, much like that illustrated in at least FIGS. 1-7 and discussed above.

Eighth Embodiment 701

Referring now to FIG. 11, an additional embodiment of a training apparatus 701 is illustrated. In various envisioned versions of this embodiment, the training apparatus 701 may be substantially similar in structure, shape, and/or configuration to that illustrated in at least FIG. 1 and discussed above. Indeed, in at least the illustrated version of this embodiment, the primary difference between training apparatuses, 701 and 1, lies in that the first and second flexible portions (e.g., wraps), 20 and 30, of the apparatus in FIG. 1 may be replaced with a plurality of narrower, elongate straps, 770, 780, 782, and 784. Notably, in certain versions of the embodiment of FIG. 11, the elongate strap 784 is configured to substantially surround the thumb of a user such that the thumb extends substantially through at least a portion of the elongate strap (e.g., as in through a hole (not shown) in the strap 784 configured and sized to receive a user's thumb).

Ninth Embodiment 801

Referring now to FIGS. 12A and 12B, an additional embodiment of a training apparatus 801 is illustrated. In various envisioned versions of this embodiment, the training apparatus 801 comprises a first body portion 811 and a second body portion 812. While at least the second body portion 812 may be substantially similar in structure, shape, and/or configuration to the second body portion 612 illustrated in FIG. 10 and discussed above, the first body portion 811 is substantially different in structure, shape, and/or configuration from any such portions discussed above. In particular, according to various versions of this embodiment, the first body portion 811 not only fully surrounds the user's upper arm, as did first body portions 211, 311, and 411, respectively, but also fully surrounds the user's elbow, extending from the user's upper arm to at least a portion of the user's forearm.

By analogy, the first body portion 811 may be similar to the third body portion 114 illustrated in FIGS. 5A-C, in that it may be configured, according to various versions of this embodiment such that it forms an angle 815 that forms a substantially 90 degree angle. In other related embodiments, the angle 815 may be in a range from about 80 to 100 degrees. In still other un-illustrated embodiments, the angle 815 may be anywhere in a range from about 60 to 120 degrees, depending on the requirements of a user, provided the first body portion 811 substantially prevents any undesirable flexion of the user's elbow during the throwing motion.

As is further evident from FIGS. 12A and 12B, the training apparatus 801 may include one or more extension mechanisms 850. According to the illustrated embodiment, such an extension mechanism 850 may comprise at least one elongated strap 851 and at least two retaining clips 852, 853. Generally speaking, a first of the retaining clips 853 may be configured to be attached to the first body portion 811 while a second of the retaining clips 852 may be configured to be attached to the second body portion 812. Further, each of the retaining clips may be configured to receive an end of the elongated strap 851, in which manner the elongated strap extendably connects the first and second body portions, 811 and 812.

Comparing further FIGS. 12A and 12B, it can be seen that, in various versions of this embodiment, adjustment of the at least one elongated strap 851 permits adjustment of a distance (e.g., D1 between the first and the second body portions, 811 and 812. For example, in a non-limiting sense, the elongated strap 851 may be adjusted between a distance D1 (shown in FIG. 12A) and a distance D2 (shown in FIG. 12B), to account for variations in the length of different users' arms. In this manner, the training apparatus 801 not only retains a degree of rigidity to prevent inadvertent flexion of the user's arm during the throwing motion, but also provides a sufficient degree of customization to permit the device to be useful to a variety of user types.

Any remaining structural features of the training apparatus 801 may be substantially the same in structure, shape, and/or configuration to at least the training apparatuses, 201 and 401, as illustrated in at least FIGS. 6 and 8 and discussed above. Alternatively, in still other embodiments (not shown), the remaining structural features of the training apparatus 801 can be substantially different in structure, shape, and/or configuration from that of similarly functional portions illustrated in any of FIGS. 1-11 and discussed above.

Tenth Embodiment 901

Referring now to FIGS. 13A and 13B, an additional embodiment of a training apparatus 901 is illustrated. In various envisioned versions of this embodiment, the training apparatus 901 is substantially similar in structure, shape, and/or configuration to that illustrated in at least FIGS. 12A and 12B and discussed above. Indeed, in at least the illustrated version of this embodiment, the primary difference between training apparatuses, 801 and 901, lies in that the training apparatus 901 may include at least two elongated straps 951 while the training apparatus illustrated in FIGS. 12A and 12B only included one. In this regard, the training apparatus 901 according to various embodiments may provide additional rigidity between the first and second body portions, 911 and 912 than that found in the training apparatus 801. Of course, additional variations and benefits may be envisioned, beyond that illustrated in FIGS. 13A and 13B.

Any remaining structural features of the training apparatus 901 not already explicitly discussed may be substantially the same in structure, shape, and/or configuration to at least the training apparatus 801 as illustrated in at least FIGS. 12A and 12B and discussed above. Alternatively, in still other embodiments (not shown), the remaining structural features of the training apparatus 901 can be substantially different in structure, shape, and/or configuration from that of similarly functional portions illustrated in any of FIGS. 1-12 and discussed above.

Eleventh Embodiment 1001

Referring now to FIGS. 14A and 14B, an additional embodiment of a training apparatus 1001 is illustrated. In various envisioned versions of this embodiment, the training apparatus 1001 is substantially similar in structure, shape, and/or configuration to that illustrated in at least FIGS. 12A-13B and discussed above. Indeed, in at least the illustrated version of this embodiment, the primary difference between training apparatuses, 801, 901, and 1001, lies in that the training apparatus 1001 may include at least two elongated straps 951, each oriented on opposing sides of a users arm (e.g., as shown adjacent the top and the bottom of the arm; alternatively, not as shown, on opposing sides of the arm). In this regard, the training apparatus 1001 according to various embodiments may provide additional rigidity between the first and second body portions, 1011 and 1012 than that found in the training apparatuses 801 and 901. Of course, additional variations and benefits may be envisioned, beyond that illustrated in FIGS. 14A and 14B.

Any remaining structural features of the training apparatus 1001 not already explicitly discussed may be substantially the same in structure, shape, and/or configuration to at least the training apparatuses 801 and 901 as illustrated in at least FIGS. 12A-13B and discussed above. Alternatively, in still other embodiments (not shown), the remaining structural features of the training apparatus 1001 can be substantially different in structure, shape, and/or configuration from that of similarly functional portions illustrated in any of FIGS. 1-13 and discussed above.

Twelfth Embodiment 1101

Referring now to FIGS. 15A and 15B, an additional embodiment of a training apparatus 1101 is illustrated. In various envisioned versions of this embodiment, the training apparatus 1101 is substantially similar in structure, shape, and/or configuration to that illustrated in at least FIGS. 12A and 12B and discussed above. Indeed, in at least the illustrated version of this embodiment, the primary difference between training apparatuses, 801 and 1101, lies in that the first and second body portions 1111 and 1112, of the apparatus may be configured, like at least the first and second body portions 11 and 12 (see FIG. 1) to receive only a portion of the user's arm (as opposed to the first and second body portions 811 and 812 that may be configured to substantially and/or fully surround the user's arm).

Any remaining structural features of the training apparatus 1101 not already explicitly discussed may be substantially the same in structure, shape, and/or configuration to at least the training apparatus 801 as illustrated in at least FIGS. 12A and 12B and discussed above. Alternatively, in still other embodiments (not shown), the remaining structural features of the training apparatus 1101 can be substantially different in structure, shape, and/or configuration from that of similarly functional portions illustrated in any of FIGS. 1-14 and discussed above.

Thirteenth Embodiment 1201

Referring now to FIG. 16A-C, an additional embodiment of a training apparatus 1201 is illustrated. In various envisioned versions of this embodiment, the training apparatus 1201 is substantially similar in structure, shape, and/or configuration to that illustrated in at least FIG. 10 and discussed above. Indeed, in at least the illustrated version of this embodiment, the primary difference between training apparatuses 601 and 1201 lies in that the pivot support assembly 660 illustrated adjacent a user's elbow in FIG. 10 is replaced with a pivot support assembly 1260 positioned adjacent a user's wrist, as illustrated in at least FIG. 16A.

As best understood from FIGS. 16A-C in conjunction with one another, the pivot support assembly 1260 functions in a similar fashion to the pivot support assembly 660 of FIG. 10, in that it enables a user to lock and/or limit flexion and/or pronation of the user's wrist. This may be important in the context of throwing a baseball, in that a certain degree of rotation may be desirable for proper release of the ball during the throwing motion. Thus, for instance, as a non-limiting example, the pivot support assembly 1260 may be configured to limit flexion of a user's wrist to between an angle A1 (shown in FIG. 16A) and an angle A2 (shown in FIG. 16B), passing through a plurality of angles such as angle A3 that may be less than A1 but greater than A2. In various versions of this particular embodiment, the angle A1 may be substantially a 225 degree angle, while the angle A2 may be substantially a 150 degree angle. In other embodiments, the angles A1-A3 may be any of a variety of angles, as desired by the user, provided at least one of the angles is configured to ensure proper release of a ball by a user during the throwing motion.

While FIGS. 16A-C depict a pivot support assembly 1260 that primarily restricts flexion of a user's wrist during the throwing motion of a baseball, it should be understood that similar pivot support assemblies (not shown) could also be used that restrict one or both flexion and pronation of the wrist in the context of throwing a football or any of a variety of other projectiles.

Unlike previously discussed embodiments, the illustrated embodiment of the training apparatus 1201 may include a second body portion 1212 that does not extend onto at least a portion of a user's palm and/or hand. In contrast, the second body portion 1212 substantially surrounds a lower portion of a user's forearm, substantially adjacent the user's wrist. To provide the rigidity between the second body portion 1212 and the user's fingers necessary to ensure proper throwing technique, the training apparatus 1201, as illustrated, may include a strap 1284 that substantially encircles at least Any remaining structural features of the training apparatus 1201 not already explicitly discussed may be substantially the same in structure, shape, and/or configuration to at least the training apparatuses 801-1001 as illustrated in at least FIGS. 12A-14B and discussed above. Alternatively, in still other embodiments (not shown), the remaining structural features of the training apparatus 1201 can be substantially different in structure, shape, and/or configuration from that of similarly functional portions illustrated in any of FIGS. 1-15 and discussed above.

Fourteenth Embodiment 1301

Referring now to FIG. 16D-F, an additional embodiment of a training apparatus 1301 is illustrated. In various envisioned versions of this embodiment, the training apparatus 1301 may be substantially similar in structure, shape, and/or configuration to the training apparatus 1201 illustrated in at least FIGS. 16A-C and discussed above. Indeed, in at least the illustrated version of this embodiment, the primary difference between training apparatuses 1201 and 1301 lies in that first and second body portions 1311 and 1312 may be configured to receive only a portion of the user's arm while the first and second body portions 1211 and 1212 may be configured to substantially encircle (e.g., fully surround) the user's arm. This distinction has been illustrated before, with reference to at least training apparatuses 101, 501, 601, 701, and 1101.

Any remaining structural features of the training apparatus 1301 not already explicitly discussed may be substantially the same in structure, shape, and/or configuration to at least the training apparatuses 801-1201 as illustrated in at least FIGS. 12A-16C and discussed above. Alternatively, in still other embodiments (not shown), the remaining structural features of the training apparatus 1301 can be substantially different in structure, shape, and/or configuration from that of similarly functional portions illustrated in any of FIGS. 1-16C and discussed above.

Fifteenth Embodiment 1401

Referring now to FIG. 17A-B, an additional embodiment of a training apparatus 1401 is illustrated. In various envisioned versions of this embodiment, the training apparatus 1401 may be substantially similar in structure, shape, and/or configuration to that illustrated in at least FIG. 16A-C and discussed above. Indeed, in at least the illustrated version of this embodiment, the primary difference between training apparatuses 1201 and 1401 lies in that the pivot support assembly 1260 illustrated adjacent a user's wrist in FIG. 16A may be replaced with a pivot brace 1460, as illustrated in at least FIG. 17B.

As best understood from FIGS. 17A-B in conjunction with one another, the pivot brace 1460 functions in a similar fashion to the pivot support assembly 1260, in that it restricts, to a certain degree, flexion and/or pronation of a user's wrist. This may be important in the context of throwing a baseball, in that a certain degree of rotation may be desirable for proper release of the ball during the throwing motion. Thus, for instance, as a non-limiting example, the pivot brace 1460 may be configured to provide rigidity and thus limit flexion of a user's wrist as it is moved through (shown in FIGS. 17A-B) a plurality of positions during the throwing process.

Notably, while FIGS. 17A-B depict a pivot brace 1460 that primarily restricts flexion of a user's wrist during the throwing motion of a baseball, it should be understood that similar pivot braces (not shown) could also be used that restrict one or both flexion and pronation of the wrist in the context of throwing a football or any of a variety of other projectiles.

Any remaining structural features of the training apparatus 1401 not already explicitly discussed may be substantially the same in structure, shape, and/or configuration to at least the training apparatuses 1201 as illustrated in at least FIGS. 16A-C and discussed above. Alternatively, in still other embodiments (not shown), the remaining structural features of the training apparatus 1401 can be substantially different in structure, shape, and/or configuration from that of similarly functional portions illustrated in any of FIGS. 1-15 and discussed above.

Sixteenth Embodiment 1501

Referring now to FIG. 17C-D, an additional embodiment of a training apparatus 1501 is illustrated. In various envisioned versions of this embodiment, the training apparatus 1501 may be substantially similar in structure, shape, and/or configuration to that illustrated in at least FIG. 16D-F and discussed above. Indeed, in at least the illustrated version of this embodiment, the primary difference between training apparatuses 1301 and 1501 lies in that the pivot support assembly 1360 illustrated adjacent a user's wrist in FIG. 16D may be replaced with a pivot brace 1560, as illustrated in at least FIG. 17D.

Any remaining structural features of the training apparatus 1501 not already explicitly discussed may be substantially the same in structure, shape, and/or configuration to at least the training apparatuses 1301 as illustrated in at least FIGS. 16D-F and discussed above. Alternatively, in still other embodiments (not shown), the remaining structural features of the training apparatus 1501 can be substantially different in structure, shape, and/or configuration from that of similarly functional portions illustrated in any of FIGS. 1-15 and discussed above.

Sports Equipment for Use with Various Embodiments

Referring now to FIGS. 18A and 18B, a standard (e.g. NFL regulation) football 2010 is provided with fingertip (or handprint, etc.) markings 2015 to aid in executing proper football throwing technique. The markings 2015 may be in a variety of forms, such as the non-limited examples of dashed lines, imprints, indentions, grooves, raised ridges, or the like, provided each provide the necessary guidance for a user to correctly place his or her fingers and thumb upon the football prior to performing a throwing motion. In at least the illustrated embodiment, the markings 2015 include finger markings along with at least one marking 2016 to assist with proper positioning of the thumb.

The markings 2015, while illustrated in FIGS. 18A and 18B for a certain sized hand, may be desirably tailored to differently-proportioned hands. The markings may, in certain embodiments, be modeled after different NFL players, who naturally exhibit a range of different hand proportions. Thus, a young player who has a certain hand conformance may learn proper throwing technique by modeling after a player having similarly shaped hands. Alternatively, supplemental markings (not shown) may be provided in certain embodiments to aid players with differently-sized hands in using the standard markings 2015. Such supplemental markings may include the non-limiting examples of lines drawn down the center of the finger markings, thereby facilitating placement of larger and smaller fingers along the same axis.

These same principles may be applicable to other items of sports equipment as well, including baseballs, volleyballs, tennis balls, and the like. FIGS. 19A and 19B generally illustrate an additional embodiment of a baseball 2020 having markings 2022 and 2024 or 2026 and 2028, depending on whether the user wishes to hold the baseball parallel or perpendicular to the laces 2021, 2027, and 2029 of the baseball. Hold variations in at least the context of baseball may result in a variety of different, but desirable throws, each with their own technique. Accordingly, it could be envisioned for baseballs, and for other items of sports equipment, to have, in certain embodiments (not shown) multiple sets of markings 2022 or 2026 each providing instructions to a user for specific throwing techniques. In such instances, the distinct markings upon a single piece of sports equipment could be distinguished relative to one another by the non-limiting examples of color saturation, grey-scale marking, and/or texture consistency.

Method of Using Various Embodiments of the Invention

Various methods of using the various embodiments discussed above exist, as commonly known and understood in the art. For purposes of exemplary disclosure, a method of using the training apparatus 1 will now be discussed with reference to at least FIGS. 1-4B. It should be understood that this method provides a non-limiting example for purposes of disclosure and methods of using certain of the remaining disclosed embodiments, along with additionally envisioned embodiments, may involve certain variations or additions to this particular method.

The first step of the method for using the training apparatus 1 involves a user placing his or her arm substantially within the body portion 10. In certain embodiments, this involves placing at least a portion of the user's upper arm adjacent the first portion 11 of the body, and at least a portion of the user's forearm adjacent the second portion 12. In so doing, according to various embodiments, at least a portion of the user's palm will be, as a result, placed adjacent a portion of the third portion 13, as shown in at least FIGS. 4A and 4B. In other embodiments, it may be necessary for a user to further adjust the positioning of the first portion 11 and/or the second portion 12 to achieve the desired positioning of the user's palm adjacent the third portion 13.

Once the user's palm and arm are positioned, as desired, adjacent the body portion 10, the next step for a user of the training apparatus 1 may be to adjust the first flexible portion 20 so that it encircles at least the portion of the user's forearm that is not encircled by the second portion 12. In various embodiments, adjustment of the first flexible portion 20 may include placing a portion of the flexible portion having at least one connector portion 25 adjacent a portion of the second portion 12 configured to attachably receive the connector portions. In certain embodiments, as shown in, for example, FIGS. 1 and 2, this involves wrapping the first flexible portion 20 over a top portion of the user's forearm and tightening it such that the user's forearm may be snugly contained within the first flexible portion and the second portion 12. Once so snugly secured, the user may, according to certain embodiments, attach the connectors 25 to the second portion 12, in a variety of fashions depending upon the type and structure of the connectors, as discussed in further detail above.

In certain embodiments, as the user is adjusting the first flexible portion 20 to snugly secure the user's forearm adjacent the second portion 12, the user must further slip his or her thumb 9 through an opening formed in the first flexible portion 20 designed to receive and retain the thumb, as shown, for example, in FIGS. 2 and 4A. In this manner, the user's thumb, along with his or her fingers will remain accessible for grasping the sports equipment (e.g., football or baseball) upon use of the training apparatus 1 for its intended purpose.

Once the user has secured his or her forearm between the first flexible portion 20 and the second portion 12, as discussed above, the next step according to various embodiments involves the user securing his or her upper arm, in a similar fashion between the second flexible portion 30 and the first portion 11 of the body 10. In other embodiments, a user may secure the second flexible portion 30 to the first portion 11 prior to securing the first flexible portion 20 to the second portion 12, depending on his or her preference or desired implementation of this method.

Once so secured, the user may be ready to practice proper throwing technique by using the training apparatus 1. In so doing, the user according to various embodiments may use sports equipment, such as the non-limiting examples of a football and baseball, as shown in FIGS. 18-19, or some other equipment according to his or her particular need or desire. Regardless of the sports equipment selected, during use of the various embodiments of the training apparatus 1, the user's arm will be substantially restricted from movement out of the orientation provided by the training apparatus, whether that be, as shown in FIG. 1, a substantially 90 degree angle 15, or another comparable angle, as desired. Such will assist a user to perfect his or her throwing technique through use of the training apparatus 1.

Conclusion

The foregoing description of the various embodiments of the present invention has been presented for purposes of illustration and description. It is not intended to be exhaustive or to limit the invention to the precise form disclosed. Obvious modifications or variations are possible in light of the above teachings. The embodiments were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention and should be interpreted in accordance with the breadth to which they are fairly, legally and equitably entitled. The drawings and preferred embodiments do not and are not intended to limit the ordinary meaning of the various embodiments in their fair and broad interpretation in any way.

What is claimed is:

1. An apparatus configured for improving a throwing technique of a user thereof, the apparatus comprising:

a first body portion configured to at least partially surround an upper arm portion of the arm of the user;

a second body portion configured to at least partially surround a lower arm portion of the arm of the user, wherein the first and the second body portions are further configured such that a relative angle is formed there-between;

a third body portion configured to at least partially surround a palm portion of a hand of the user, wherein the third body portion comprises a wedge portion, the wedge portion being configured to protrude from a substantially planar surface of the third body portion and toward the palm portion of the hand of the user so as to create a gap between the palm portion and the substantially planar surface of the third body portion such that the wedge portion is positioned intermediate the substantially planar surface of the third body portion and the palm portion of the hand of the user;

one or more flexible portions configured to at least partially surround and secure at least a second portion of the arm of the user, the second portion being oppositely positioned relative to the first portion; and at least one connector element configured to selectively attach the one or more flexible portions to the one or more body portions.

2. The apparatus of claim 1, wherein at least one of the first and the second body portions substantially surround a portion of the arm of the user.

3. The apparatus of claim 1, wherein the relative angle is in a range from 60° to 120°.

4. The apparatus of claim 1, wherein the relative angle is in a range from 80° to 100°.

5. The apparatus of claim 1, wherein the relative angle is substantially 90°.

6. The apparatus of claim 1, wherein the first and the second body portions are formed from a single piece of material.

7. The apparatus of claim 6, wherein the single piece of material is selected from a group consisting of polycarbonate, polyvinyl chloride, polyethylene terephthalate, low density polyethylene, high density polyethylene, and any combination thereof.

8. The apparatus of claim 1, wherein the first and the second body portions are formed from separate pieces of material.

9. The apparatus of claim 8, further comprising an extension mechanism, the extension mechanism being configured so as to slidably position the first and the second body portions relative to one another.

10. The apparatus of claim 9, wherein the first and the second body portions are configured to be selectively slidably positioned between a first extended position and a second retracted position.

11. The apparatus of claim 10, wherein the first extended position accommodates a user having an arm with a first length and the second extended position accommodates a user having an arm with a second length, the second length being less than the first length.

12. The apparatus of claim 10, wherein the first and the second body portions are configured to be selectively slidably positioned through a plurality of positions intermediate the first extended position and the second retracted position.

13. The apparatus of claim 9, wherein the extension mechanism comprises at least one peg and at least two slots integrally formed within the respective one or more body portions.

14. The apparatus of claim 9, wherein the extension mechanism comprises an elongate strap formed separately from the respective one or more body portions.

15. The apparatus of claim 8, further comprising a rotation mechanism, the rotation mechanism being configured so as to rotate the first and the second body portions relative to one another.

16. The apparatus of claim 15, wherein the rotation mechanism is a hinge assembly.

17. The apparatus of claim 16, wherein the hinge assembly is selectively rotatable through a range from 60° to 120°.

18. The apparatus of claim 1, wherein the gap is sufficient to prevent the palm portion of the hand of the user from contacting a ball being thrown during use.

19. The apparatus of claim 1, wherein the third body portion further comprises a ring portion and a strap portion, the ring portion being configured to substantially surround and immobilize a thumb on the hand of the user during use of the apparatus, the strap portion being configured to operatively connect the ring portion with the wedge portion.

20. The apparatus of claim 19, wherein the third body portion further comprises a finger portion, the finger portion being configured to substantially surround and immobilize the fingers on the hand of the user during use of the apparatus.

21. The apparatus of claim 1, wherein the second and the third body portions are formed from a single piece of material.

22. The apparatus of claim 1, wherein the second and the third body portions are formed from separate pieces of material.

23. The apparatus of claim 22, wherein the second and the third body portions are configured to be selectively slidably positioned through a plurality of positions intermediate a first extended position and a second retracted position, the first extended position being configured to accommodate a user having an arm with a first length and the second retracted position being configured to accommodate a user having an arm with a second length, the second length being less than the first length.

24. The apparatus of claim 1, further comprising a rotation mechanism, the rotation mechanism being configured so as to rotate the second and the third body portions relative to one another.

25. The apparatus of claim 24, wherein the rotation mechanism is a hinge assembly selectively rotatable through a range from 150° to 225°.

26. The apparatus of claim 1, wherein the one or more flexible portions comprise:

a first flexible portion configured to at least partially surround an upper arm portion of the arm of the user; and a second flexible portion configured to at least partially surround a lower arm portion of the arm of the user.

27. The apparatus of claim 26, wherein:

the first flexible portion and the first body portion at least partially surround opposing upper arm portions of the arm of the user such that the first flexible portion and the first body portion together substantially encircle a circumference of the upper arm portion of the arm of the user; and the second flexible portion and the second body portion at least partially surround opposing lower arm portions of the arm of the user such that the second flexible portion and the second body portion together substantially encircle a circumference of the lower arm portion of the arm of the user.

28. The apparatus of claim 26, wherein at least one of the first and the second flexible portions substantially surround the arm of the user such that at least a portion of the substantially surrounding flexible portion overlays at least a portion of at least one of the first and the second body portions.

29. The apparatus of claim 26, wherein the at least one connector element comprises at least three connector elements located on the second flexible portion and at least one connector element located on the first flexible portion.

30. The apparatus of claim 1, wherein at least a portion of the at least one connector element is formed from an adhesive material.

31. The apparatus of claim 1, wherein the connector element is selected from a group consisting of: fabric-based hook and loop configurations, magnets, clips, hooks, and any combination thereof.

32. The apparatus of claim 1, further comprising a liner, the liner configured to coat at least a portion of an interior surface of the one or more body portions.

33. The apparatus of claim 32, wherein the liner is formed from a material selected from a group consisting of polyurethane foam, latex foam, slab foam, fiber batting-wrapped foam cushions, fibrous polyester batting, bonded polyester batting, cotton felt, and any combination thereof.

34. The apparatus of claim 24, further comprising a locking mechanism, the locking mechanism being configured so as to selectively lock the second and the third body portions at a lock angle relative to one another during use of the apparatus.

35. The apparatus of claim 34, wherein the lock angle is within a range of 150° to 225°.

36. An apparatus configured for improving a throwing technique of a user thereof, the apparatus comprising:

a first body portion configured to at least partially surround at least an upper arm portion of an arm of the user;

a second body portion having an upper section and a lower section, the second body portion collectively extending along a lower arm portion and a hand portion of the user, the upper section being configured to at least partially surround at least the lower arm portion, the lower section of the second body portion comprising a wedge and being configured to at least partially surround the hand portion of the user;

a first flexible portion, the first flexible portion being configured to at least partially surround and secure the upper arm of the user, such that the first flexible portion and the first body portion together substantially encase and immobilize the upper arm of the user; and a second flexible portion, the second flexible portion being configured to at least partially surround and secure the lower arm and hand of the user, such that the second flexible portion and the second body portion together substantially encase and immobilize the lower arm and hand of the user, wherein:

the first and the second body portions are further configured such that a relative angle is formed there-between; and the wedge of the second body portion is further configured to protrude from the second body portion and toward a palm portion of the hand of the user so as to create a gap between the palm portion of the user's hand and the second body portion and such that the wedge is positioned intermediate the second body portion and the palm portion of the hand of the user, the gap further preventing contact between the palm of the user's hand and a ball during use of the apparatus.

37. The apparatus of claim 36, further comprising a rotation mechanism and a lock mechanism, the rotation mechanism being configured so as to enable rotation of the second and the third body portions relative to one another, the lock mechanism being configured so as to selectively lock rotation mechanism such that the second and the third body portions are immobilized at a lock angle relative to one another during use of the apparatus.

38. A method of using an apparatus so as to throw a ball with an improved throwing technique, the method comprising the steps of:

A) inserting at least a first portion of a user's arm within an apparatus such that the apparatus at least partially surrounds at least the first portion of the user's arm, wherein the apparatus comprises:

(i) a first body portion configured to at least partially surround an upper arm portion of the arm of the user;

(ii) a second body portion configured to at least partially surround a lower arm portion of the arm of the user, wherein the first and the second body portions are further configured such that a relative angle is formed there-between; and (iii) a third body portion configured to at least partially surround a palm portion of a hand of the user, wherein the third body portion comprises a wedge portion, the wedge portion being configured to protrude from a substantially planar surface of the third body portion and toward the palm portion of the hand of the user so as to create a gap between the palm portion and the substantially planar surface of the third body portion, such that the wedge portion is positioned intermediate the substantially planar surface of the third body portion and the palm portion of the hand of the user;

B) selectively connecting, via at least one connector element of the apparatus, one or more flexible portions of the apparatus to the one or more body portions of the apparatus, such that the one or more flexible portions at least partially surround and secure at least a second portion of the user's arm relative to the one or more body portions, the second portion being oppositely positioned relative to the first portion; and C) throwing a ball with the user's arm constrained within the apparatus, such that the ball is thrown with an improved throwing technique provided at least in part by use of the apparatus.

39. The method of claim 38, further comprising the step of, prior to Step "C", adjusting the relative positioning of the one or more body portions via an extension mechanism, the extension mechanism being configured to slidably position the one or more body portions relative to each other so as to accommodate differing lengths of the arms of respective users.

40. The method of claim 38, further comprising the step of, prior to Step "C", adjusting the relative positioning of the one or more body portions via a rotation mechanism, the rotation mechanism being configured to selectively rotatably position the one or more body portions relative to each other so as to provide an improved throwing technique.

41. The method of claim 40, further comprising the step of, prior to Step "C" and subsequent to adjusting the relative positioning of the one or more body portions via a rotation mechanism, locking the rotation mechanism via a locking mechanism so as to immobilize the one or more body portions relative to one another at a lock angle within a range from 150° to 225°.

* * * * *